US005682572A

United States Patent [19]

Murai et al.

[11] Patent Number: 5,682,572

[45] Date of Patent: Oct. 28, 1997

[54] IMAGE DENSITY CONTROL METHOD FOR AN IMAGE RECORDER

[75] Inventors: Kazuo Murai, Tokyo; Shinji Kato, Kawasaki; Hisao Murayama, Yokohama, all of Japan

[73] Assignee: Ricoh Company, Ltd., Tokyo, Japan

[21] Appl. No.: 432,767

[22] Filed: May 2, 1995

Related U.S. Application Data

[63] Continuation of Ser. No. 105,810, Aug. 13, 1993, Pat. No. 5,475,476, which is a continuation-in-part of Ser. No. 790,487, Nov. 12, 1991, Pat. No. 5,237,370.

[30] Foreign Application Priority Data

Nov. 13, 1990 [JP] Japan ..... 2-306711

[51] Int. Cl.[6] ..... G03G 15/08

[52] U.S. Cl. ..... 399/27

[58] Field of Search ..... 355/203, 204, 355/208, 209, 245, 246, 77; 430/31; 364/148; 399/24, 27, 30, 258

[56] References Cited

U.S. PATENT DOCUMENTS

| | | | |
|---|---|---|---|
| 4,932,356 | 6/1990 | Watanabe et al. | 355/208 X |
| 5,006,896 | 4/1991 | Koichi et al. | 355/246 |
| 5,057,870 | 10/1991 | Aoki | 355/246 |
| 5,142,332 | 8/1992 | Osawa et al. | 355/208 |
| 5,150,135 | 9/1992 | Casey et al. | 355/208 X |

*Primary Examiner*—Sandra L. Brase

*Attorney, Agent, or Firm*—Oblon, Spivak, McClelland, Maier & Neustadt, P.C.

[57] ABSTRACT

An image density control method applicable to an electrophotographic copier or similar image recorder for controlling the toner concentration of a two-component developer, i.e., a mixture of toner and carrier to maintain the density of a toner image produced by the developer constant. Predetermined calculations are performed on the basis of the output of a photosensor which is responsive to the toner images representative of reference patterns formed on a photoconductive element.

16 Claims, 33 Drawing Sheets

FIG. 2

| | R | dR | | TONER SUPPLY OUTPUT |
|---|---|---|---|---|
| RULE [I] | SMALL | ZR | ⇨ | SMALL |
| RULE [II] | MEDIUM | ZR | ⇨ | MEDIUM |
| RULE [III] | LARGE | ZR | ⇨ | LARGE |
| RULE [IV] | SMALL | BELOW NM | ⇨ | ZERO |
| RULE [V] | SMALL | PM | ⇨ | MEDIUM |
| RULE [VI] | SMALL | PL | ⇨ | LARGE |
| RULE [VII] | MEDIUM | NM | ⇨ | SMALL |
| RULE [VIII] | MEDIUM | NL | ⇨ | ZERO |
| RULE [IX] | MEDIUM | ABOVE PM | ⇨ | LARGE |
| RULE [X] | LARGE | NM | ⇨ | MEDIUM |
| RULE [XI] | LARGE | NL | ⇨ | SMALL |
| RULE [XII] | LARGE | ABOVE PM | ⇨ | LARGE |
| RULE [XIII] | MINIMUM | | ⇨ | ZERO |
| RULE [XIV] | MAXIMUM | | ⇨ | ZERO |

FIG. 6

| | R | dR | | TONER SUPPLY OUTPUT | INTERVAL BETWEEN TONER IMAGE FORMATION |
|---|---|---|---|---|---|
| RULE [I] | SMALL | ZR | ⇨ | SMALL | P |
| RULE [II] | MEDIUM | ZR | ⇨ | MEDIUM | P |
| RULE [III] | LARGE | ZR | ⇨ | LARGE | P |
| RULE [IV] | SMALL | NM | ⇨ | ZERO | Z |
| RULE [V] | SMALL | NL | ⇨ | ZERO | N |
| RULE [VI] | SMALL | PM | ⇨ | MEDIUM | Z |
| RULE [VII] | SMALL | PL | ⇨ | LARGE | N |
| RULE [VIII] | MEDIUM | NM | ⇨ | SMALL | Z |
| RULE [IX] | MEDIUM | NL | ⇨ | ZERO | N |
| RULE [X] | MEDIUM | PM | ⇨ | LARGE | Z |
| RULE [XI] | MEDIUM | PL | ⇨ | LARGE | N |
| RULE [XII] | LARGE | NL | ⇨ | SMALL | N |
| RULE [XIII] | LARGE | NM | ⇨ | MEDIUM | Z |
| RULE [XIV] | LARGE | PM | ⇨ | LARGE | Z |
| RULE [XV] | LARGE | PL | ⇨ | LARGE | N |
| RULE [XVI] | MAXIMUM | ALL | ⇨ | ZERO | N |
| RULE [XVII] | MINIMUM | ALL | ⇨ | ZERO | N |

108
CLUTCH SOL
107
SOL DRIVE
PATTERN TONER IMAGE FORMED WHEN ERASURE CONTROL IS ON
111
LATCH
LIMITER
112
110
ADDER/ SUBTRACTOR
ERROR PROCESSING
109
ERROR COUNTER
106
FUZZY CONTROLLER
iR
118
SUBTRACTOR
117
MEAN CCT
R
105
dR
SUBTRACTOR
104
113
114
115
116
LATCH
LATCH
LATCH
LATCH
LATCH
Vsp/Vsg
103
MPU
101
102
ADC
P SENSOR

FIG. 10

| | R | dR | iR | | TONER SUPPLY OUTPUT | INTERVAL BETWEEN TONER IMAGE FORMATION | ERROR COUNT |
|---|---|---|---|---|---|---|---|
| RULE [I] | ALL | ZR | ALL | ⇨ | R | P | 0 |
| RULE [II] | SMALL | NL | ALL | ⇨ | ZERO | N | 0 |
| RULE [III] | SMALL | NM | ALL | ⇨ | ZERO | Z | 0 |
| RULE [IV] | SMALL | PM | ALL | ⇨ | MEDIUM | Z | 0 |
| RULE [V] | SMALL | PL | ZORN | ⇨ | MEDIUM | N | 0 |
| RULE [VI] | SMALL | PL | P | ⇨ | LARGE | N | 0 |
| RULE [VII] | MEDIUM | NM | ALL | ⇨ | SMALL | Z | 0 |
| RULE [VIII] | MEDIUM | NL | ZORP | ⇨ | SMALL | N | 0 |
| RULE [IX] | MEDIUM | NL | N | ⇨ | ZERO | N | 0 |
| RULE [X] | MEDIUM | PM | ALL | ⇨ | LARGE | Z | 0 |
| RULE [XI] | MEDIUM | PL | ALL | ⇨ | LARGE | N | 0 |
| RULE [XII] | LARGE | NM | ALL | ⇨ | MEDIUM | Z | 0 |
| RULE [XIII] | LARGE | NL | ZORP | ⇨ | MEDIUM | Z | 0 |
| RULE [XIV] | LARGE | NL | N | ⇨ | SMALL | N | 0 |
| RULE [XV] | LARGE | PM | ALL | ⇨ | LARGE | Z | 0 |
| RULE [XVI] | LARGE | PL | ALL | ⇨ | LARGE | N | 0 |
| RULE [XVII] | MAXIMUM | ALL | ALL | ⇨ | ZERO | N | +1 |
| RULE [XVIII] | MAXIMUM | ALL | ALL | ⇨ | ZERO | N | +1 |

FIG. 15

RULE [I]: IF Vsp/Vsg IS MEDIALLY HIGH AND DIFFERENCE FROM PREVIOUS ONE IS ALMOST 0, INCREASE TONER SUPPLY PER UNIT IMAGE FORMING SIGNAL TO +.

RULE [II]: IF Vsp/Vsg IS SLIGHTLY HIGH AND DIFFERENCE FROM PREVIOUS ONE IS SLIGHTLY +, INCREASE TONER SUPPLY PER UNIT IMAGE FORMING SIGNAL MEDIALLY TO +

RULE [III]: IF Vsp/Vsg IS SLIGHTLY HIGH AND DIFFERENCE FROM PREVIOUS ONE IS SLIGHTLY -, INCREASE TONER SUPPLY PER UNIT IMAGE FORMING SIGNAL SLIGHTLY TO +.

RULE [IV]: IF Vsp/Vsg IS ALMOST TARGET AND DIFFERENCE FROM PREVIOUS ONE IS ALMOST 0, CHANGE TONER SUPPLY PER UNIT IMAGE FORMING SIGNAL LITTLE.

RULE [V]: IF Vsp/Vsg IS SLIGHTLY LOW AND DIFFERENCE FROM PREVIOUS ONE IS SLIGHTLY +, INCREASE TONER SUPPLY PER UNIT IMAGE FORMING SIGNAL SLIGHTLY TO -.

RULE [VI]: IF Vsp/Vsg IS SLIGHTLY LOW AND DIFFERENCE FROM PREVIOUS ONE IS SLIGHTLY -, INCREASE TONER SUPPLY PER UNIT IMAGE FORMING SIGNAL MEDIALLY TO -.

RULE [VII]: IF Vsp/Vsg IS MEDIALLY LOW AND DIFFERENCE FROM PREVIOUS ONE IS ALMOST 0, INCREASE TONER SUPPLY PER UNIT IMAGE FORMING SIGNAL TO -.

FIG. 19

RULE [I]: IF Vsp/Vsg IS MEDIALLY HIGH AND DIFFERENCE FROM PREVIOUS ONE IS ALMOST 0, INCREASE TONER SUPPLY PER UNIT IMAGE FORMING SIGNAL TO +.

RULE [II]: IF Vsp/Vsg IS SLIGHTLY HIGH AND DIFFERENCE FROM PREVIOUS ONE IS SLIGHTLY +, INCREASE TONER SUPPLY PER UNIT IMAGE FORMING SIGNAL MEDIALLY TO +.

RULE [III]: IF Vsp/Vsg IS SLIGHTLY HIGH AND DIFFERENCE FROM PREVIOUS ONE IS SLIGHTLY -, INCREASE TONER SUPPLY PER UNIT IMAGE FORMING SIGNAL SLIGHTLY TO +.

RULE [IV]: IF Vsp/Vsg IS ALMOST TARGET AND DIFFERENCE FROM PREVIOUS ONE IS ALMOST 0, CHANGE TONER SUPPLY PER UNIT IMAGE FORMING SIGNAL LITTLE.

RULE [V]: IF Vsp/Vsg IS SLIGHTLY LOW AND DIFFERENCE FROM PREVIOUS ONE IS SLIGHTLY +, INCREASE TONER SUPPLY PER UNIT IMAGE FORMING SIGNAL SLIGHTLY TO -.

RULE [VI]: IF Vsp/Vsg IS SLIGHTLY LOW AND DIFFERENCE FROM PREVIOUS ONE IS SLIGHTLY -, INCREASE TONER SUPPLY PER UNIT IMAGE FORMING SIGNAL MEDIALLY TO -.

RULE [VII]: IF Vsp/Vsg IS MEDIALLY LOW AND DIFFERENCE FROM PREVIOUS ONE IS ALMOST 0, INCREASE TONER SUPPLY PER UNIT IMAGE FORMING SIGNAL TO -.

RULE [VIII]: IF INPUT CONCENTRATION IS SLIGHTLY LOW AND DIFFERENCE FROM PREVIOUS ONE IS ALMOST 0, LOWER TARGET SLIGHTLY.

RULE [IX]: IF INPUT CONCENTRATION IS ALMOST TARGET AND DIFFERENCE FROM PREVIOUS ONE IS ALMOST 0, CHANGE TARGET LITTLE.

RULE [X]: IF INPUT CONCENTRATION IS SLIGHTLY HIGH AND DIFFERENCE FROM PREVIOUS ONE IS ALMOST 0, LOWER TARGET SLIGHTLY.

FIG. 23A

RULE [I]: IF OPERATION TIME OF DEVELOPING UNIT IS VERY SHORT AND TEMPERATURE AND HUMIDITY ARE HIGH, SET UP TARGET A.

RULE [II]: IF OPERATION TIME OF DEVELOPING UNIT IS VERY SHORT AND TEMPERATURE AND HUMIDITY ARE MEDIUM, SET UP TARGET B.

RULE [III]: IF OPERATION TIME OF DEVELOPING UNIT IS VERY SHORT AND TEMPERATURE AND HUMIDITY ARE LOW, SET UP TARGET C.

RULE [IV]: IF OPERATION TIME OF DEVELOPING UNIT IS SHORT AND TEMPERATURE AND HUMIDITY ARE HIGH, SET UP TARGET D.

RULE [V]: IF OPERATION TIME OF DEVELOPING UNIT IS SHORT AND TEMPERATURE AND HUMIDITY ARE MEDIUM, SET UP TARGET E.

RULE [VI]: IF OPERATION TIME OF DEVELOPING UNIT IS SHORT AND TEMPERATURE AND HUMIDITY ARE LOW, SET UP TARGET F.

RULE [VII]: IF OPERATION TIME OF DEVELOPING UNIT IS LONG AND TEMPERATURE AND HUMIDITY ARE HIGH, SET UP TARGET E.

RULE [VIII]: IF OPERATION TIME OF DEVELOPING UNIT IS LONG AND TEMPERATURE AND HUMIDITY ARE MEDIUM, SET UP TARGET F.

RULE [IX]: IF OPERATION TIME OF DEVELOPING UNIT IS LONG AND TEMPERATURE AND HUMIDITY ARE LOW, SET UP TARGET G.

FIG. 23B

RULE [X]: IF CONCENTRATION IS MEDIALLY LOWER THAN TARGET AND RATE OF CHANGE IS ALMOST 0, INCREASE TONER SUPPLY PER UNIT IMAGE FORMING SIGNAL TO +.

RULE [XI]: IF CONCENTRATION IS SLIGHTLY LOWER THAN TARGET AND RATE OF CHANGE IS SLIGHTLY -, INCREASE TONER SUPPLY PER UNIT IMAGE FORMING SIGNAL MEDIALLY TO +.

RULE [XII]: IF CONCENTRATION IS SLIGHTLY LOWER THAN TARGET AND RATE OF CHANGE IS SLIGHTLY +, INCREASE TONER SUPPLY PER UNIT IMAGE FORMING SIGNAL SLIGHTLY TO +.

RULE [XIII]: IF CONCENTRATION IS ALMOST TARGET AND RATE OF CHANGE IS ALMOST 0, CHANGE TONER SUPPLY PER UNIT IMAGE FORMING SIGNAL LITTLE.

RULE [XIV]: IF CONCENTRATION IS SLIGHTLY HIGHER THAN TARGET AND RATE OF CHANGE IS SLIGHTLY -, INCREASE TONER SUPPLY PER UNIT IMAGE FORMING SIGNAL SLIGHTLY TO -.

RULE [XV]: IF CONCENTRATION IS SLIGHTLY HIGHER THAN TARGET AND RATE OF CHANGE IS SLIGHTLY +, INCREASE TONER SUPPLY PER UNIT IMAGE FORMING SIGNAL MEDIALLY TO -.

RULE [XVI]: IF CONCENTRATION IS MEDIALLY HIGHER THAN TARGET AND RATE OF CHANGE IS ALMOST 0, INCREASE TONER SUPPLY PER UNIT IMAGE FORMING SIGNAL TO -.

FIG. 27

RULE [I]: IF AGITATOR TORQUE IS SLIGHTLY LOW, INCREASE ROTATION SPEED OF TONER SUPPLY ROLLER SLIGHTLY.

RULE [II]: IF AGITATOR TORQUE IS MEDIALLY LOW, INCREASE ROTATION SPEED OF TONER SUPPLY ROLLER MEDIALLY.

RULE [III]: IF AGITATOR TORQUE IS VERY LOW, INCREASE ROTATION SPEED OF TONER SUPPLY ROLLER GREATLY.

RULE [IV]: IF DIFFERENCE FROM AGITATOR TORQUE IS SLIGHTLY NEGATIVE, INCREASE ROTATION SPEED OF TONER SUPPLY ROLLER SLIGHTLY.

RULE [V]: IF DIFFERENCE FROM AGITATOR TORQUE IS MEDIALLY NEGATIVE, INCREASE ROTATION SPEED OF TONER SUPPLY ROLLER MEDIALLY.

FIG. 30

RULE [I]: IF REMAINDER OF TOTAL COUNT IS SMALL, INCREASE BIAS VERY SLIGHTLY.

RULE [II]: IF REMAINDER OF TOTAL COUNT IS MEDIUM, INCREASE BIAS SLIGHTLY.

RULE [III]: IF REMAINDER OF TOTAL COUNT IS LARGE, INCREASE BIAS MEDIALLY AND INCREASE ILLUMINATION SLIGHTLY.

RULE [IV]: IF REMAINDER OF TOTAL COUNT IS VERY LARGE, INCREASE BIAS AND ILLUMINATION MEDIALLY.

RULE [V]: IF REMAINDER OF TOTAL COUNT IS SLIGHTLY LARGE TO -, INCREASE BIAS SLIGHTLY.

RULE [VI]: IF REMAINDER OF TOTAL COUNT IS MEDIALLY LARGE TO -, INCREASE BIAS MEDIALLY.

IMAGE DENSITY CONTROL METHOD FOR AN IMAGE RECORDER

CROSS REFERENCE TO RELATED APPLICATION

This is a Continuation of application Ser. No. 08/105,810 filed on Aug. 13, 1993 now U.S. Pat. No. 5,475,436 which is a Continuation In Part of Ser. No. 07/790,487 filed Nov. 12, 1991 now U.S. Pat. No. 5,237,370.

BACKGROUND OF THE INVENTION

The present invention relates to a method applicable to an electrophotographic copier or similar image recorder for controlling the density of an image in such a manner as to maintain it constant at all times.

In the above-described type of image recorder, a latent image electrostatically formed on an image carrier by a predetermined procedure is developed by a toner, i.e., colored fine particles fed from a developing device. The toner is usually charged to the opposite polarity to the latent image and electrostatically deposited on the latent image. To charge the toner to such a polarity, it may be combined with a carrier to constitute a two-component developer and agitated together with the carrier for frictional charging. While this kind of development using a two-component developer is capable of charging the toner sufficiently, the toner concentration sequentially decreases since only the toner is consumed during development. Therefore, the toner concentration of the developer, i.e., the density of an image to be developed by the toner has to be controlled to a predetermined value. This may be done by measuring the current toner concentration of the developer and, based on the measured toner concentration, controlling the amount of toner supply, i.e. the amount of toner to be fed to the carrier.

The toner concentration of the developer may be directly determined in terms of the weight or the permeability of the developer. Such direct measurement may be replaced with indirect measurement which uses a white reference pattern and a black reference pattern. Specifically, for the indirect measurement, latent images representative of a white and a black reference pattern are electrostatically formed on a photoconductive element and developed by a developer. The densities of the resulting toner images are measured by a photoelectric arrangement. More specifically, a photosensor or so-called P sensor is located in close proximity to the surface of the photoconductive element to sense the densities of the toner images of the reference patterns, so that a particular amount of toner supply is selected on the basis of the ratio of the sensed densities. This kind of scheme, therefore, determines a change in the density of each toner image of interest in terms of a change in the toner concentration of the developer, i.e., the mixture ratio of toner and carrier. An electrophotographic copier, for example, using such a method effects the measurement once every time ten copies are produced.

The conventional control method using a P sensor as stated above has the following problems left unsolved.

(1) Since the toner supply begins only after the toner concentration has lowered, the toner concentration sharply changes when documents of the kind consuming much toner are continuously copied, preventing the toner concentration from remaining constant.

(2) Since no consideration is given to the interval between the supply of toner and the resulting increase in toner concentration, the toner concentration is scattered over a broad range, i.e., the control accuracy is not satisfactory.

(3) Toner images representative of the reference patterns are formed once every ten copies without exception, as stated earlier. Hence, when a document of the kind consuming a relatively small amount of toner is copied a plurality of times, it is likely that a greater amount of toner is consumed by the toner images of the reference patterns than by the images of the document. On the other hand, when documents to be sequentially copied are of the kind consuming a great amount of toner, the conventional control method cannot accurately follow the change in the amount of toner.

Moreover, with the conventional image density control method, it is impossible to supply a toner in an amount accurately matching the toner consumption at all times since the amount of toner consumed during the intervals wherein the toner images of the reference patterns are not formed noticeably changes depending on the pixel density of a document and varying ambient conditions. Specifically, changes in the pixel density occurring during such intervals (stated another way, changes in the amount of toner consumption) disturb the photosensor output feedback line. This might be compensated for if the toner images of the reference patterns were formed more frequently to increase the amount of feedback. However, such an approach would aggravate the wasteful toner consumption and increase the load to act on a cleaning unit.

Japanese Patent Laid-Open Publication No. 33704/1988 teaches a scheme using first detecting means for detecting the amount of toner consumed by counting image forming signals, and second detecting means for detecting the amount of toner scattered around by determining the operation time of a developing roller. This scheme maintains the toner concentration constant by supplying a toner in response to the outputs of the two detecting means. However, the problem is that the ability of a developing unit changes since the relation between the image forming signal and the amount of toner consumption changes with a change in the charging ability of the carrier which is ascribable to the deterioration of the developer due to the varying environment. As a result, it is difficult to maintain the ideal image quality (toner concentration) overcoming the varying ambient conditions.

Generally, a two-component developer applicable to, e.g., an electrophotographic copier sequentially reduces the above-mentioned charging ability due to deterioration ascribable to aging. In addition, in a low temperature and low humidity environment, the charge accumulation degree and, therefore, Q/M increases; in a high temperature and high humidity environment, the charge leak degree and, therefore, Q/M decreases. It has been customary to determine a control value by considering only the influence of one or two factors individually. This is contradictory to the fact that many correlated factors effect Q/M, i.e., an optimal control value has to be determined in consideration of many pluralistic information, as mentioned above. Consequently, changes in environment cannot be coped with, preventing high image quality from being maintained.

Regarding image density, it is a common practice for the operator to manually select a desired image density by entering ambiguous "light" or "dark" information in terms of a quantized stepwise numerical value. As a result, the actual image density is not always identical with the desired one.

As for a toner supply member, when the amount of toner remaining in a toner hopper changes, the transport efficiency of the supply member changes. Hence, the toner cannot be supplied in a constant amount when the toner supply condition is maintained the same.

Assume that a toner is consumed continuously in a great amount and the supply of a great amount of toner is needed, as when a black solid image is formed. Then, the target image density cannot be easily maintained since the amount of toner sharply changes.

When the deterioration of a toner is detected, it has been customary to simply control the image density without giving consideration to the cause of the deterioration. This is not always satisfactory in effecting optimal control.

In addition, a conventional image recorder has a temperature sensor and a humidity sensor responsive to the environment and disposed within a developing unit thereof. In this condition, the toner is apt to smear the sensors to lower their sensing ability.

SUMMARY OF THE INVENTION

It is, therefore, an object of the present invention to provide an image density control method which insures a stable image density by eliminating sharp changes in toner concentration.

It is another object of the present invention to provide an image density control method which reduces the scattering in toner concentration by taking account of the interval between the supply of toner and the resulting increase in toner concentration, thereby enhancing accurate image density control.

It is another object of the present invention to provide an image density control method which consumes a minimum amount of toner.

It is another object of the present invention to provide an image density control method which performs stable control without regard to the amount of toner consumed for documents.

It is another object of the present invention to provide an image density control method capable of coping with all the possible ambient conditions, as would ordinary arise, by obtaining pluralistic information and evaluating them totally.

It is another object of the present invention to provide an image density control method insuring more stable image density than conventional methods by sharply responding to changes in environment and the kind of a document.

It is another object of the present invention to provide an image density control method which eliminates wasteful toner consumption, increase in the load on a cleaning unit, decrease in copying speed and so forth ascribable to the formation of toner images of reference patterns and, in addition, capable of controlling image density in the same manner as with a conventional photosensor.

It is another object of the present invention to provide an image density control method capable of setting up a desired image density by adequately processing ambiguous light/dark information entered.

It is another object of the present invention to provide an image density control method capable of maintaining the amount of toner supply constant despite changes in the amount of toner remaining in a toner hopper.

It is another object of the present invention to provide an image density control method capable of maintaining a target image density even when a great amount of toner is continuously consumed and a great amount of toner has to be supplemented.

It is another object of the present invention to provide an image density control method capable of effecting optimal image density control in matching relation to the cause of deterioration of a developer.

It is another object of the present invention to provide an image density control method which protects temperature and humidity sensors from contamination to insure stable detection.

In accordance with the present invention, an image density control method for controlling the density of a toner image formed on a photoconductive element by a developing unit comprises the steps of totally estimating a developing ability of the developing unit in response to a plurality of data including an operation time of the developing unit, a toner concentration, an amount of toner consumption, an amount of toner supply, a remaining amount of toner to be supplied, a reflection density ratio of a toner image of a reference pattern sensed by a photosensor, a temperature and a humidity around the developing unit, and at least one of history data thereof, and selectively controlling at least one of a latent image forming condition, a toner supply condition, a member for charging a developer, and a bias condition for development.

Also, in accordance with the present invention, an image density control method for controlling the density of a toner image formed on a photoconductive element comprises the steps of estimating an amount of toner supply required to maintain a desired image density in response to a reflection density ratio of a toner image of a reference pattern sensed by a photosensor, and history data thereof, and controlling an amount of toner supply on the basis of the result of the estimation.

Also, in accordance with the present invention, an image density control method for controlling the density of a toner image formed on a photoconductive element by a developing unit comprises the steps of estimating an amount of toner supply required to maintain a desired image density in response to a toner concentration, a difference between the toner concentration and a target toner concentration, and history data thereof, and controlling an amount of toner supply on the basis of the result of the estimation.

Further, in accordance with the present invention, an image density control method for controlling the density of a toner image formed on a photoconductive element comprises the steps of estimating a control value for a toner supply member on the basis of an amount of toner remaining in a toner hopper and history data thereof, such that an amount of toner supply remains constant, and controlling the toner supply member on the basis of the result of the estimation. Furthermore, in accordance with the present invention, an image density control method for controlling the density of a toner image formed on a photoconductive element comprises the steps of adding up signals for each supplying a toner in response to an image forming signal, while producing a count, supplying the toner in an amount corresponding to the count, estimating at least a bias condition for development and an image forming condition on the basis of the total count of the signals, and selectively controlling a plurality of objects on the basis of the result of the estimation.

Moreover, in accordance with the present invention, an image density control method for controlling the density of a toner image formed on a photoconductive element comprises the steps of estimating an amount of toner supply required to maintain a desired image density in response to a toner concentration, a difference between the toner concentration and a target toner concentration, and history data thereof, controlling toner supply on the basis of the result of the estimation, and estimating a desired toner concentration from a reflection density ratio of a toner image of a reference pattern sensed by a photosensor, and history data thereof per unit image forming signal.

In addition, in accordance with the present invention, an image density control method for controlling the density of a toner image formed on a photoconductive element by a developing unit comprises the steps of estimating a developing ability of the developing unit in terms of a combination of membership functions associated with causes which effect the developing ability and include a stress acting on a developer, an environment, and a change in toner concentration, and selectively controlling either of a toner supply condition and a bias condition for development on the basis of the result of the estimation.

BRIEF DESCRIPTION OF THE DRAWINGS

The above and other objects, features and advantages of the present invention will become more apparent from the following detailed description taken with the accompanying drawings in which:

FIG. 2 shows rules particular to the first embodiment;

FIG. 6 shows rules particular to the second embodiment;

FIG. 10 shows rules particular to the third embodiment;

FIG. 15 shows rules particular to the fourth embodiment;

FIG. 19 shows rules particular to the fifth embodiment;

FIGS. 23A and 23B show rules particular to the sixth embodiment;

FIG. 27 shows rules particular to the seventh embodiment;

FIG. 30 shows rules particular to the eighth embodiment;

DESCRIPTION OF THE PREFERRED EMBODIMENTS

Figure 1:
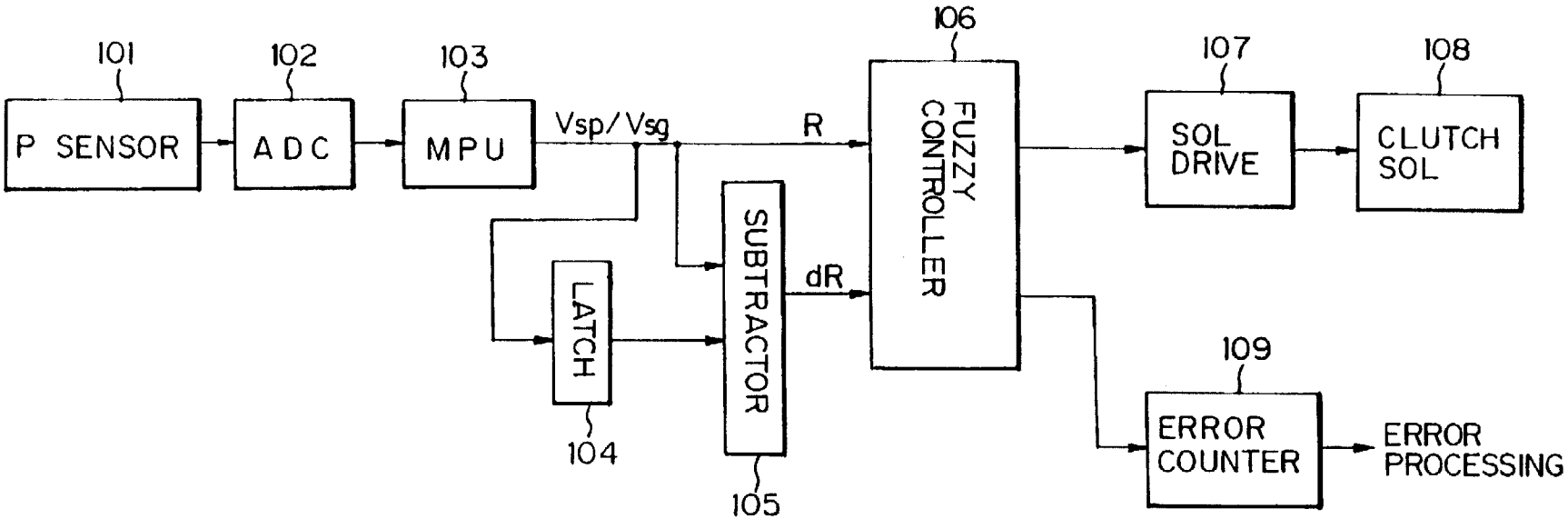
FIG. 1 is a block diagram schematically showing a control device for practicing a first embodiment of the image density control method in accordance with the present invention.

To better understand the present invention, a brief reference will be made to a copier using a conventional image density control method, shown in FIG. 11. As shown, the copier has a glass platen 401 on which a document, not shown, is laid. An image printed on the document is focused onto the surface of a photoconductive drum 406 via a first mirror 402, a second mirror 403, an in-mirror lens 404, and a third mirror 405. The mirrors 402 and 403 are driven to the left at a predetermined speed in synchronism with the rotation (counterclockwise as viewed in the figure) of the drum 406. A latent image electrostatically formed on the drum 406 is developed by a developer deposited on a developing roller 407*a* which is included in a developing device 407. The developer is made up of a toner and a carrier. The resulting toner image on the drum 406 is transferred to a recording medium, e.g., paper sheet, by a transfer charger 408. The paper sheet with the toner image is transported to a fixing station, not shown, by a belt 409. Reference patterns which are a white pattern $P_0$ and a black pattern $P_1$ are positioned in a projection field where the home position of the first mirror 402 is defined. As the mirror 402 is moved to the left for scanning the document, latent images representative of the white pattern $P_0$ and black pattern $P_1$ are electrostatically formed on the drum 406 in succession.

A photosensor or so-called P sensor 410 is interposed between the developing device 407 and the transfer charger 408 to sense the density of a toner image formed on the drum 406. The output of the P sensor 410 is amplified and shaped in waveform by an amplifier 411 and then applied to an analog-to-digital converter (ADC) 412, the resulting digital output of the ADC 412 is fed to a microprocessor (MPU) 413. The MPU 413 calculates the ratio of toner images representative of the reference patterns $P_0$ and $P_1$, i.e., Vsp/Vsg and determines an amount of toner to be supplied on the basis of the calculated ratio. Specifically, during a period of time matching the amount of toner supply, the MPU 413 delivers a turn-on command to a solenoid driver 414. In response, the solenoid driver 414 energizes a clutch solenoid 415 with the result that a toner supply roller 416 is rotated to feed a toner from a reservoir to the developing device 407.

Figure 11:
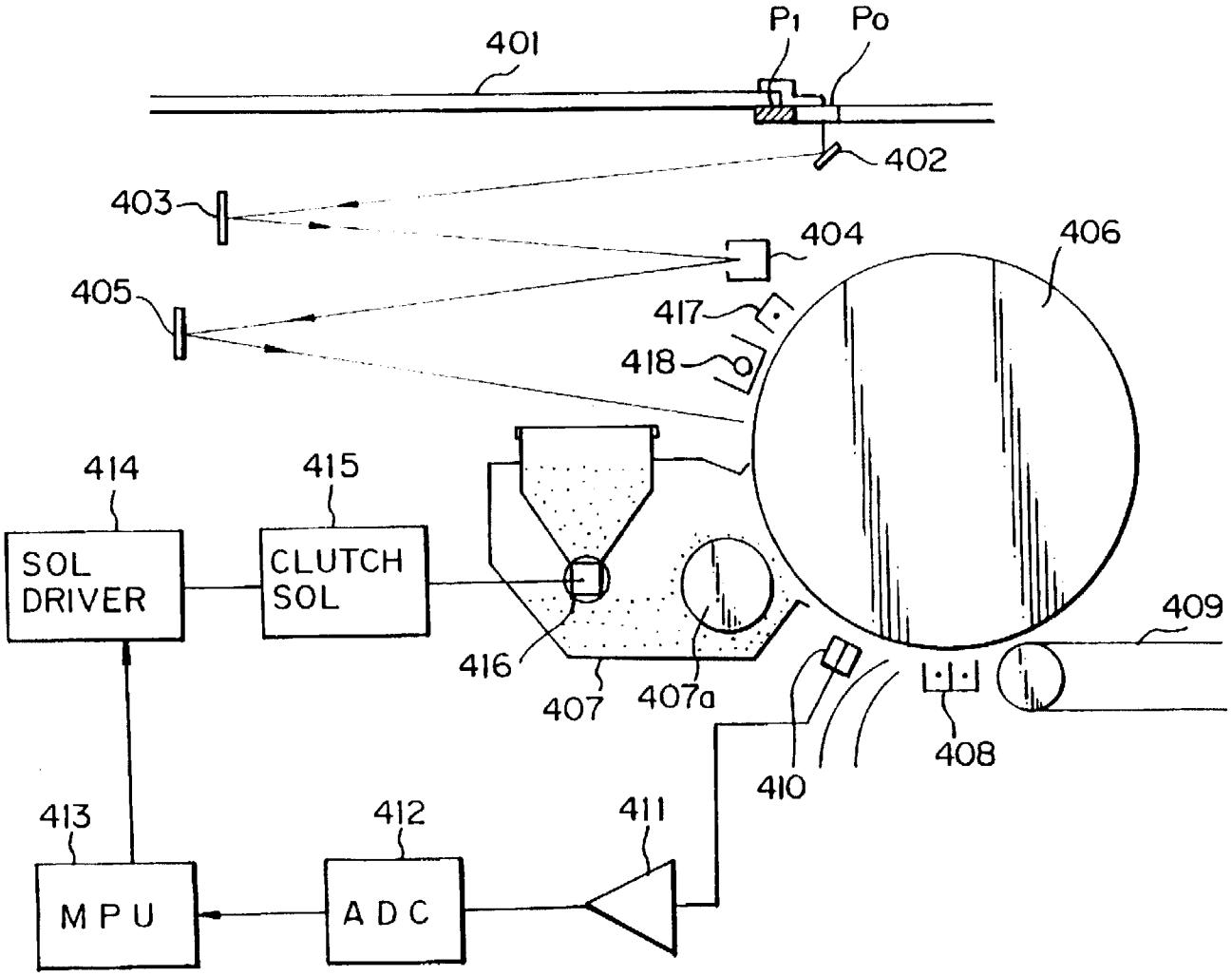
FIG. 11 PRIOR ART
FIG. 11 shows an electrophotographic copier using a conventional image density control method.

There are also shown in FIG. 11, a main charger for uniformly charging the surface of the drum 406, and an erase lamp 418 for discharging a predetermined area of the charged surface of the drum 406 to which the reference patterns $P_0$ and $P_1$ are to be projected. The erase lamp 417 is controllably turned on such that the latent images of the reference patterns $P_0$ and $P_1$ are formed on the drum 406 once every ten copies, the P sensor 410 sensing the densities of the resulting toner images.

Figure 12A:
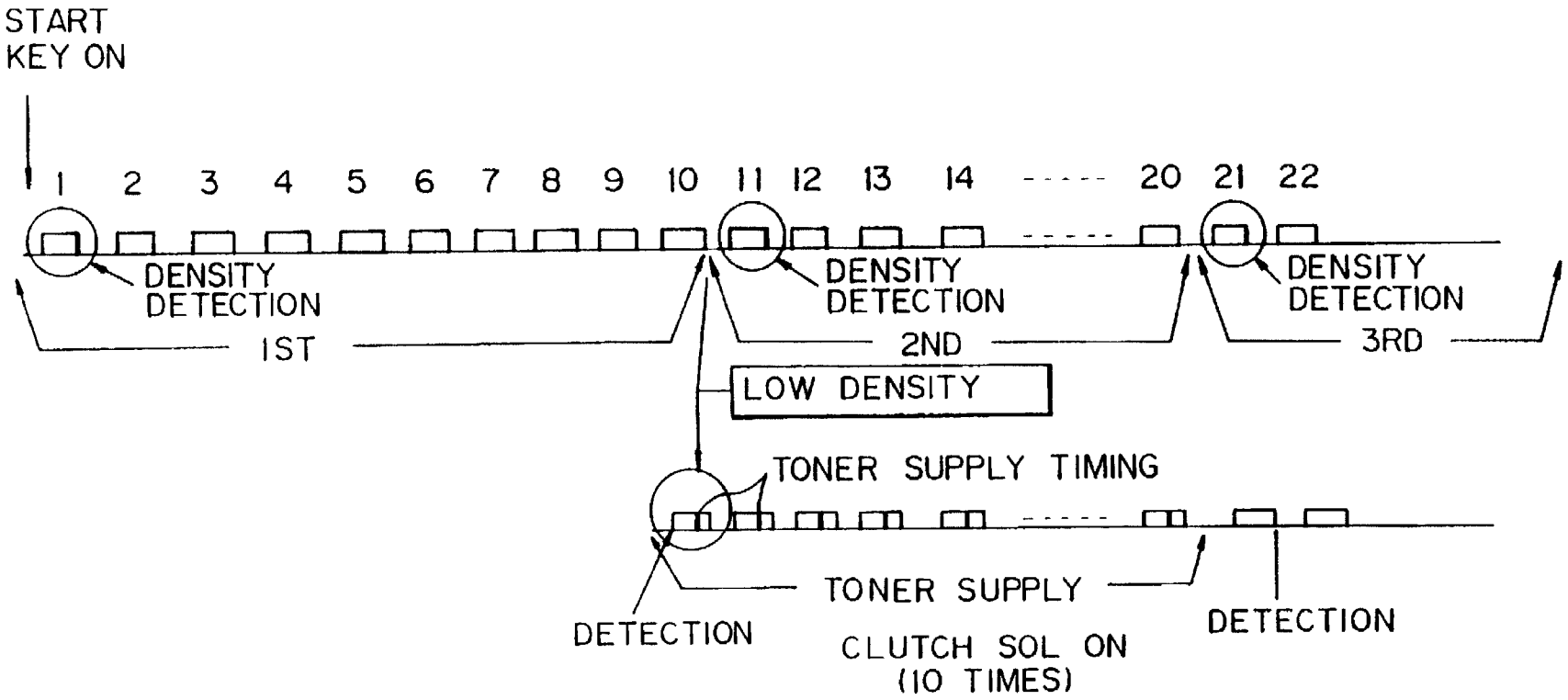
FIG. 12A PRIOR ART
FIGS. 12A–12E demonstrate the conventional image density control method.

A reference will be made to FIGS. 12A–12E for describing the conventional image density control method. The method using the P sensor 410 determines a change in toner concentration, i.e., the mixture ratio of toner and carrier in terms of changes in the densities of the reference pattern images and controls the image density by supplying an adequate amount of toner matching the change in toner concentration. As shown in FIG. 12A, the image density is sensed when the first copy is produced after the turn-on of a start key and every time ten copies are produced thereafter. When the image density is low as determined by the MPU 413, the clutch solenoid 415 is turned on and then turned off for each of ten copies until the next time for sensing the toner density, thereby continuously supplying the toner via the toner supply roller 416. On the other hand, the erase lamp 417 is turned off when the image density should be sensed, whereby the latent images of the white pattern $P_0$ and black pattern $P_1$ are formed on the drum 406. As the toner images representative of the reference patterns $P_0$ and $P_1$ arrive at the P sensor 410, the sensor 410 turns on light emitting diodes to illuminate such toner images and receives reflections from the toner images to determine their densities.

Figure 12B:
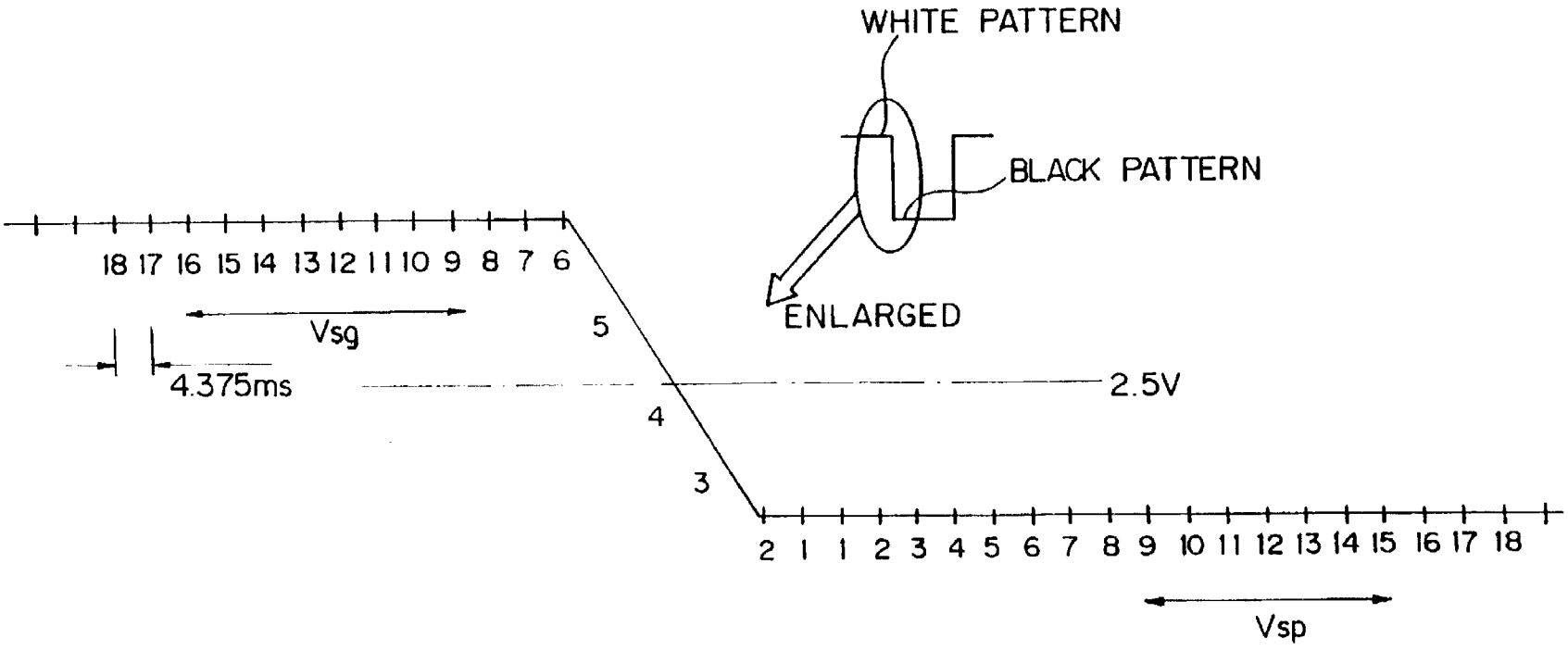
FIG. 12B PRIOR ART
Figure 12C:
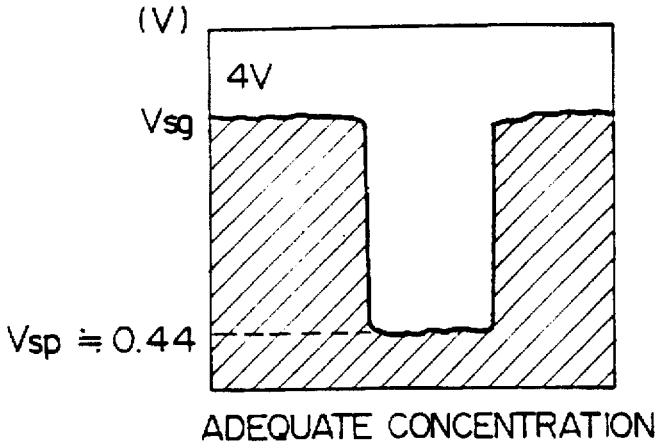
FIG. 12C PRIOR ART
Figure 12D:
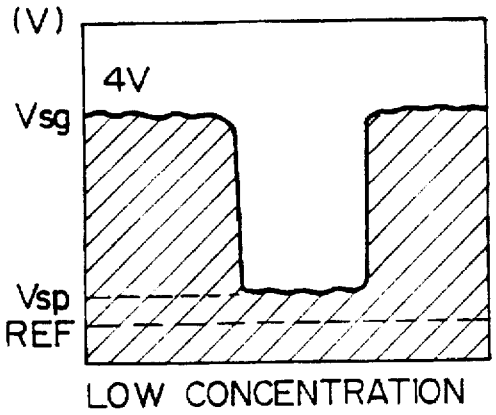
FIG. 12D PRIOR ART
Figure 12E:
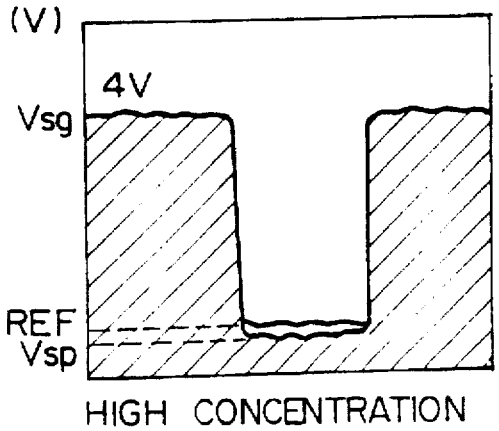
FIG. 12E PRIOR ART

As shown in FIG. 12B, when the toner density is low (representative of white pattern $P_0$), the reflection is intense so that the output of the P sensor 410 is a large value. Conversely, when the toner density is high (representative of black pattern $P_1$), the output of the P sensor 410 is a small value since the reflection is not intense. The MPU 413 averages 9–16 having appeared before the input data from the P sensor 410 lowers to below 2.5 volts four consecutive times, thereby producing Vsg. To produce Vsp, the MPU 413 averages 9–16 having appeared after the input data from the P sensor 410 lowers to below 2.5 volts four consecutive times. As shown in FIG. 12C, assume that Vsg is 4 volts, and that Vsp is about 0.44 volt so long as the toner concentration of the developer is adequate. Then, as the toner concentration lowers, the density of the toner image on the drum 406 also lowers. As a result, as shown in FIG. 12D, Vsp becomes higher than 0.44 volt. When the toner concentration is high, Vsp becomes lower than 0.44 volt since the density of the toner image increases, as shown in FIG. 12E. It is, therefore, possible to determine whether or not to supply the toner on the basis of Vsp. In practice, since Vsg is not always 4 volts, the toner supply is controlled on the basis of a reference ratio Vsp/Vsg=1/9 (nearly equal to 0.44/4).

The conventional image density control method described above has the previously discussed problems (1)–(3).

Preferred embodiments of the present invention will be described hereinafter.

First Embodiment

Referring to FIG. 1, an image density control device for practicing a first embodiment of the present invention is shown. As shown, the control device has a photosensor or P sensor 101 for sensing the density of each toner image representative of a reference pattern, i.e., a value relating to the image density. An ADC 102 converts the output of the P sensor 101. The resulting digital value relating to the image density is applied to an MPU 103 which then produces a ratio Vsp/Vsg (=R). A latch 104 latches the output of the MPU 103. A subtractor 105 produces a difference dR between the content of the latch 104 (immediately preceding R) and the current R from the MPU 103. A fuzzy controller 106 controls the amount of toner supply or executes error processing, in response to R and dR fed thereto from the MPU 103 and subtractor 105, respectively. A solenoid driver 107 energizes a clutch solenoid 108 a particular period of time in response to a toner supply signal from the fuzzy controller 106. An error counter 109 counts errors which the fuzzy controller 106 produces by error processing.

Figure 3A:
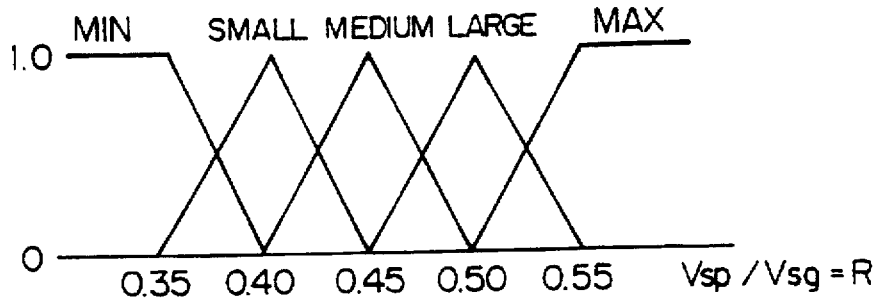
FIGS. 3A–3C show membership functions particular to the first embodiment.
Figure 3B:
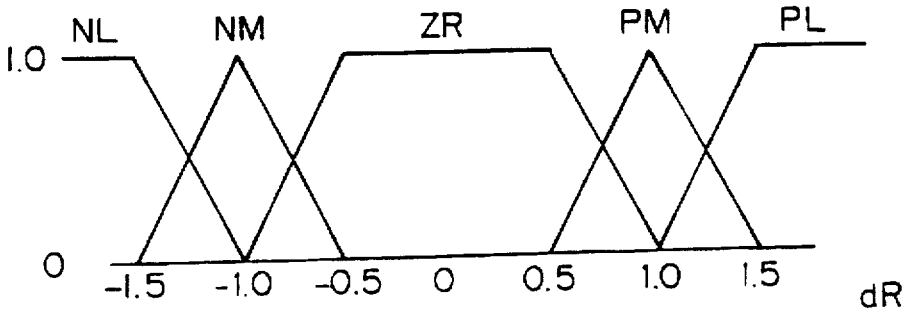
Figure 3C:
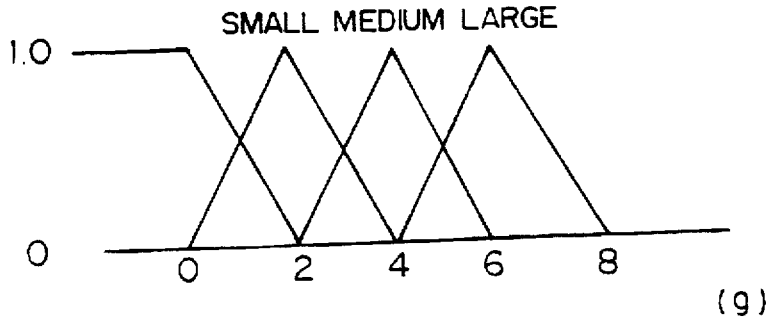

In operation, assume that control device, like the conventional one, senses the toner image density, once every ten copies, i.e., causes the formation of toner images representative of the reference patterns on a photoconductive drum once every ten copies. To begin with, the ADC 102 converts the densities of the toner images of interest sensed by the P sensor 101 to digital values, and the MPU 103 calculates Vsp/Vsg. Vsp/Vsg from the MPU 103 is fed to the fuzzy controller 106 together with a difference dR between Vsp/Vsg=R and the immediately preceding R (content of latch 104). In response, the fuzzy controller 106 executes toner supply processing or error processing according to the rules shown in FIG. 2. The fuzzy controller 106 has membership functions shown in FIGS. 3A, 3B and 3C and assigned to R, dR, and toner supply output, respectively.

Figure 4:
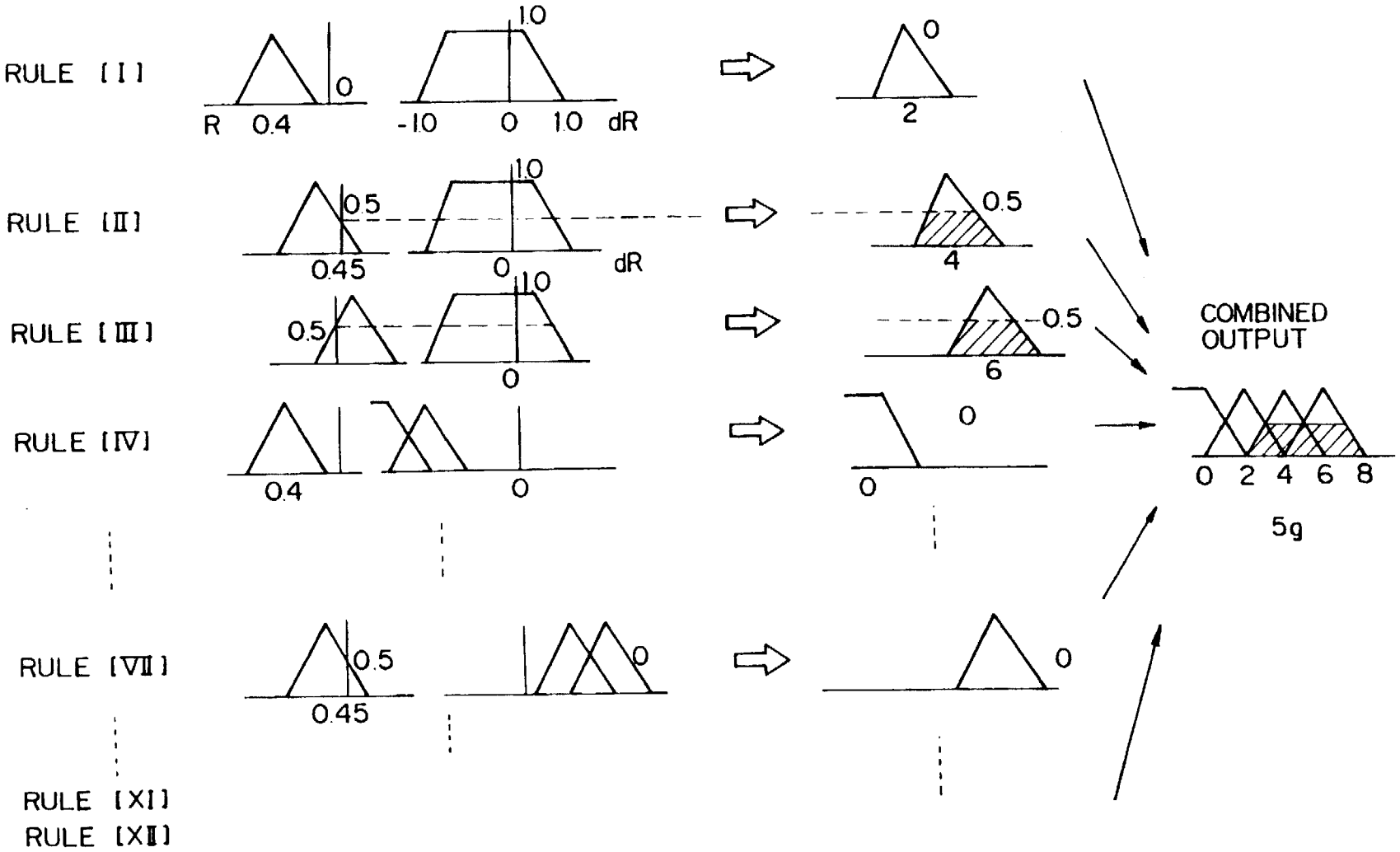
FIG. 4 demonstrates the operation of the first embodiment.

Specifically, assuming R=0.475 and dR=0.025, the fuzzy controller 106 determines an amount of toner supply, as shown in FIG. 4, according to the rules shown in FIGS. 2 and 3A–3C. First, the fuzzy controller 106 produces the values of the points where R=0.475 intersects the membership functions of the respective rules shown in FIG. 3A (zero if the former does not intersect the latter). Then, the fuzzy controller 106 calculates the values of the points of intersection associated with the respective rules shown in FIG. 3B. Thereafter, the fuzzy controller 106 determines the minimum one of the calculated values of the points of intersection associated with each rule. As a result, the fuzzy controller 106 obtains zero from rule [I], 0.5 from rule [II], 0.5 from rule [III], and zero from rules [IV]–[XIV]. Subsequently, the fuzzy controller 106 determines the values of toner supply output membership functions (shown in FIG. 3C) corresponding to the above-mentioned values. In this example, there are obtained an area defined by the values of toner supply outputs "medium" and "large" which are smaller than 0.5 on the basis of the rules [II] and [III], as indicated by hatching in FIG. 4 (the rest being zero). The outputs based on the rules [I]–[XIV] are added together to produce a trapezoid, as shown at the right-hand side in FIG. 4. Finally, the fuzzy controller 106 determines an amount of toner supply by defuzzy processing. Generally, defuzzy processing is executed by calculating the center of gravity of the combined output. In this example, the fuzzy controller 106 outputs 5g by the defuzzy processing. By using 5g, the fuzzy controller 106 turns on the solenoid driver 107, i.e., the clutch solenoid 108 for each copy so as to supply the determined amount of toner. Further, in the case of rules [XIII] and [XIV] (R being the maximum or the minimum), the error counter 109 is incremented by 1 (one). As the error counter 109 is incremented three consecutive times, error processing is executed to stop the toner supply while displaying the error.

As stated above, the illustrative embodiment uses a difference dR to promote more accurate density control than in the case with R only. Especially, the embodiment remarkably enhances accurate density control when the density is sharply changed. Moreover, when, e.g., the image area ratio of a document is not constant or widen the supply of toner is not immediately reflected by the toner density, the embodiment approximates such a factor which cannot be readily defined by a control function by using fuzzy reasoning using membership functions. This is successful in promoting firm image density control.

While the MPU 103, fuzzy controller 106, latch 104 and subtractor 105 are shown and described as comprising independent units, the embodiment is, of course, practicable even when all such functions are implemented by software and assigned to MPU. It is to be noted that at the instant when the power source is turned on, no values are latched in the latch 104 and, therefore, dR is apt to have a great value. In such a condition, it is necessary to control the density only by R or to store the existing value immediately before the turn-off of the power source by a back-up battery and latch it on the turn-on of the power source.

Second Embodiment

Figure 5:
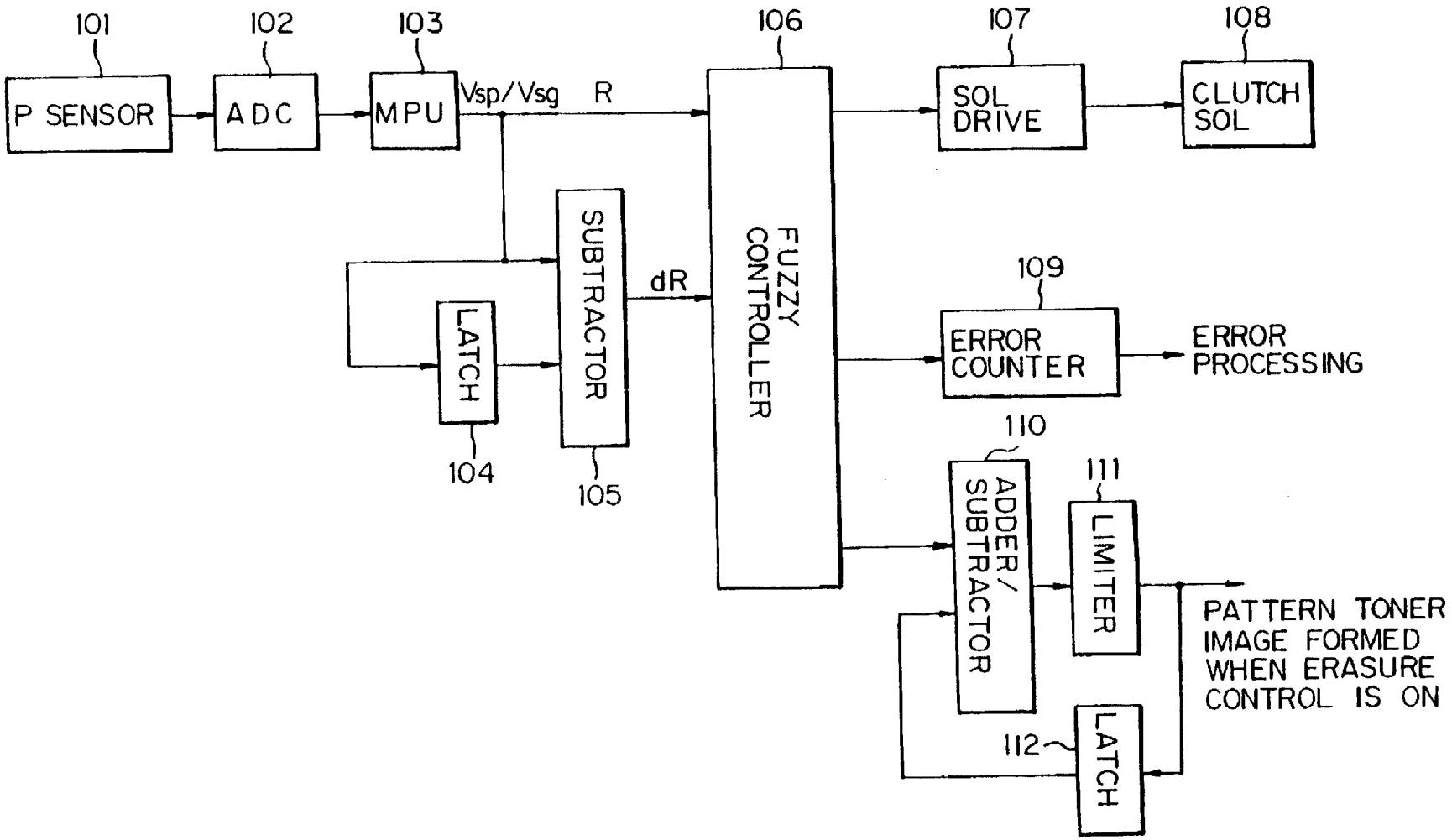
FIG. 5 is a block diagram schematically showing a second embodiment of the present invention.

Referring to FIG. 5, a second embodiment of the present invention is shown and has an erasure control section made up of an adder/subtractor 110, a limiter 111, and a latch 112, in addition to the construction of the first embodiment, FIG. 1. The rest of the construction will not be described to void redundancy.

Figure 7A:
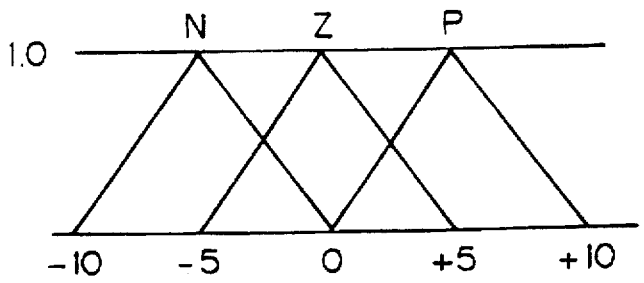
FIG. 7A shows membership functions particular to the second embodiment.
Figure 7B:
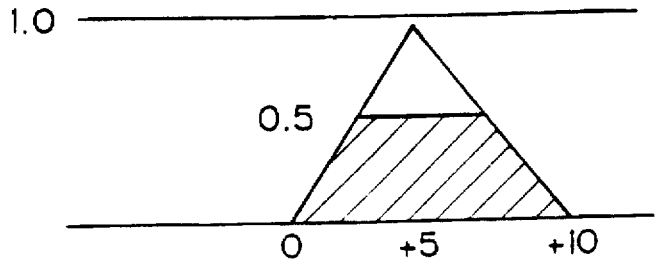
FIG. 7B shows a combined output.

In this particular embodiment, the erase control section controls the number of times that the toner concentration should be sensed, i.e., the number of times that toner images representative of the reference patterns should be formed on the photoconductive element. FIG. 7A shows membership functions assigned to the number of times of formation of the toner images, while FIG. 6 shows rules associated therewith. Assuming that R=0.475 and dR=0.025 by way of example, 5*g* is output as an amount of toner supply, as in the first embodiment. In this case, among the rules [I]–[XVII], the rules [II] and [III] match so that the interval between the successive formation of toner patterns is P based on rules [II] and [III] and zero based on the other rules. As a result, a combined output shown in FIG. 7B and, therefore, a defuzzy output of +5 is produced. Then, the adder/subtractor 110 outputs the sum of the immediately preceding interval (content of latch 112) and 5. Assuming that the immediately preceding interval is 10, meaning that the toner images of interest were formed once per ten times last time, then they will be formed once per 15 copies this time. The output of the adder/subtractor 110 has a maximum value of 20 and a minimum value of 5 as limited by the limiter 111. Hence, when the adder/subtractor 110 produces a value greater than 20 or a value smaller than 5, the latch 112 stores 20 or 5.

In this manner, in portions where the change is not noticeable, the embodiment increases the interval between the successive formation of toner images to thereby save the toner. Conversely, in portions where the change is noticeable, the embodiment reduces the interval to enhance accurate toner supply control.

In this embodiment, it is necessary to set the abovestated interval at, e.g., ten copies and latch it at the time when the power source is turned on.

Third Embodiment

Figure 9:
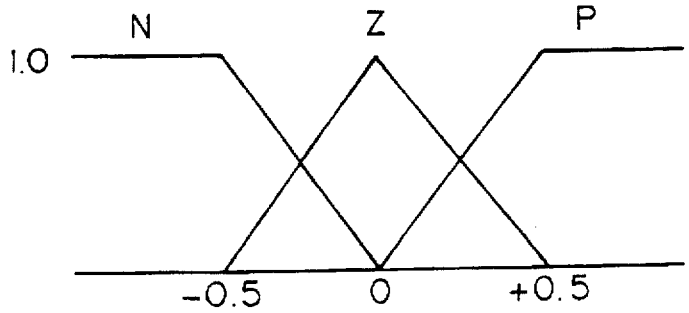
FIG. 9 shows membership functions particular to the third embodiment.
Figure 8:
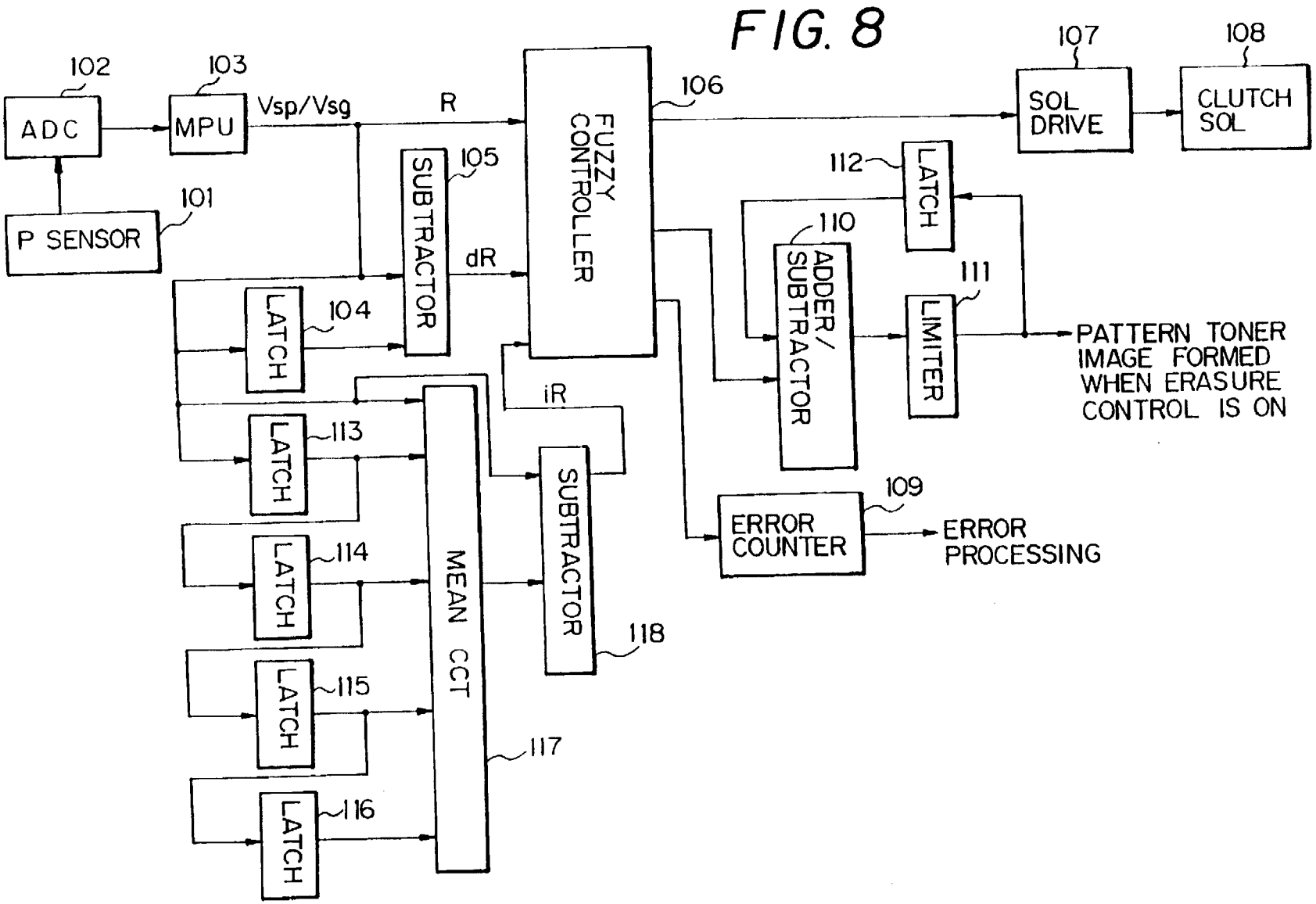
FIG. 8 is a block diagram schematically showing a third embodiment of the present invention.

FIG. 8 shows a third embodiment of the present invention which is similar to the second embodiment except that it additionally has latches 113–116, a mean circuit 117, and a subtractor 118. The following description will concentrate only on the components which are particular to this embodiment. Regarding the fuzzy controller 106, it is identical with that of the second embodiment except that it receives an additional input iR. This input iR is produced by latching four consecutive Rs preceded the current R input, then averaging five Rs in total, and then subtracting the resulting mean value from the current value. FIG. 9 shows membership functions for inputting iR while FIG. 10 shows rules associated therewith.

Specifically, as shown in FIG. 10, assume that R matching rules [VIII] and [IX] is "medium", and that dR is NL (e.g. when the current R is 0.45 and the immediately preceding R is 0.6). In such a case, the second embodiment would fully interrupt the toner supply. By contrast, this embodiment determines, when the mean value of the previous values is greater than the current value, i.e., when it is smaller than "medium", that the above-mentioned value 0.6 is erroneous and makes the toner supply output rule [VIII] "small"; when the difference of mean value is greater than N, i.e., "medium" of mean values, stops the toner supply by the rule [IX], as in the second embodiment, determining that the toner consumption is rapid. This is successful in further enhancing accurate control. While this embodiment simplifies the rules by using a difference as iR, it is also practicable with a mean value itself. Then,

| | R | dR | iR |
|---|---|---|---|
| rule [VIII] | medium | NL | below "medium" |
| rule [IX] | medium | NL | above "medium" |

Fourth Embodiment

Figure 13:
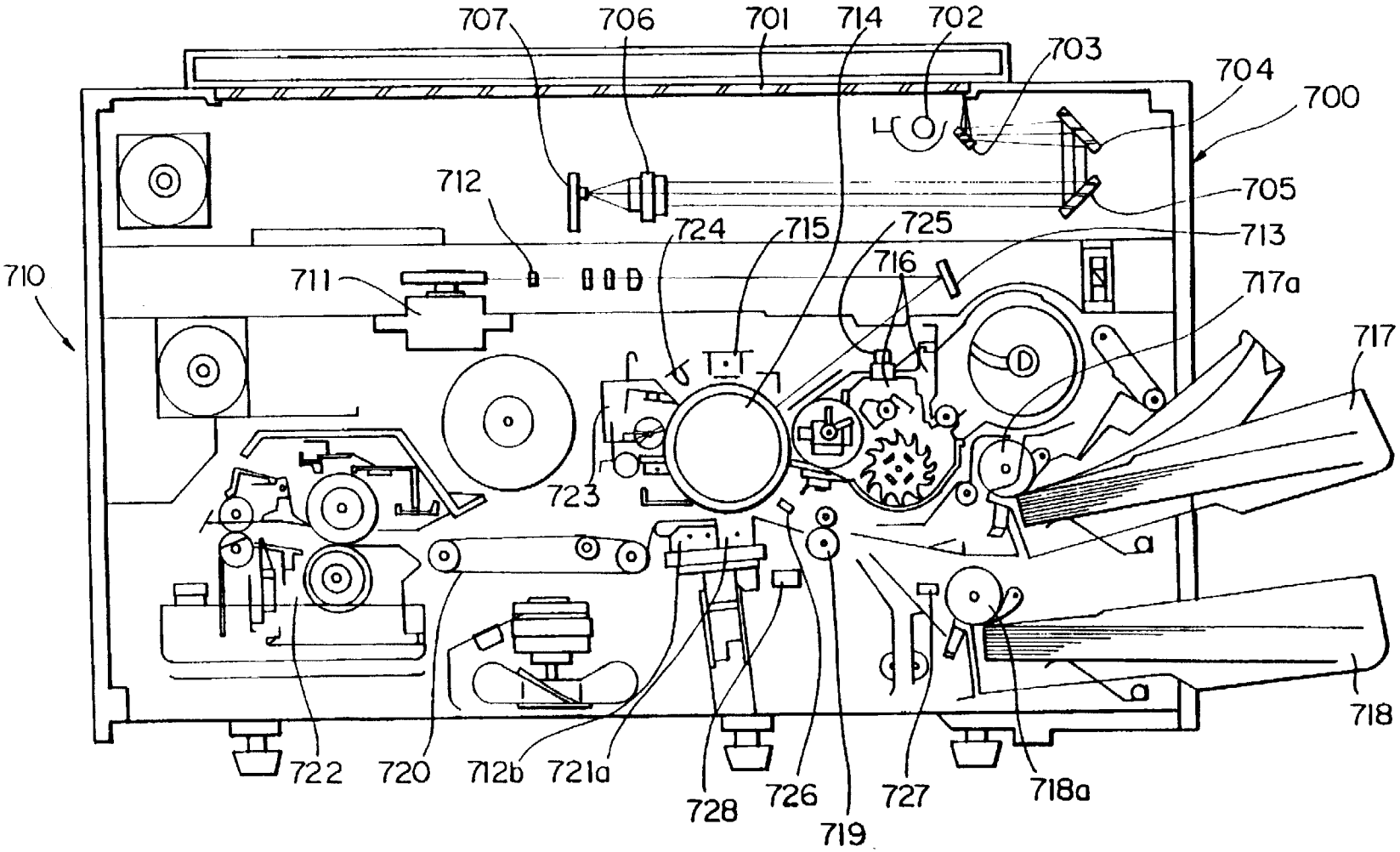
FIG. 13 is a section of an image recorder with which a fourth embodiment of the present invention is practicable.

Referring to FIG. 13, an image recorder for practicing a fourth embodiment of the present invention is shown. As shown, the image recorder has an image reading section 700, and an image forming section 710 for transferring image data read by the reading section 700 to a recording medium, e.g., paper sheet.

The image reading section 700 has a glass platen 701 on which a document is to be laid, a light source 702 for illuminating the document on the glass platen 701 while moving relative to the document, a mirror 703 for deflecting a reflection from the document while moving together with the light source 702, mirrors 704 and 705 for sequentially reflecting the imagewise light from the mirror 703 in a predetermined direction, a lens 706 for focusing the light from the mirror 705, and a CCD 707 to which the light from the lens 706 is incident. The image forming section 710 has a polygon mirror 711 rotatable at high speed for steering a laser beam at a constant angle, an f-theta lens 712 for correcting the laser beam from the polygon mirror 711 such that it has a constant interval on a photoconductive drum 714, a mirror 713 for reflecting the laser beam from the f-theta lens 712 to the drum 714, a main charger 715 for uniformly charging the surface of the drum 714, and a developing unit 716 for developing an electrostatic latent image formed on the drum 714 by the laser beam.

Cassettes 717 and 718 are removably mounted on the recorder body, and each is loaded with paper sheets of particular size. Pick-up rollers 717*a* and 718*a* are respectively associated with the cassettes 717 and 718 for feeding the paper sheets one by one to an image transfer station. A registration roller 719 drives the paper sheet fed from the cassette 717 or 718 toward the image transfer station at a predetermined timing. A transfer charger 721*a* transfers the toner image formed on the drum 714 to the paper sheet driven by the registration roller 719. A separation charger 721*b* separates the paper sheet from the drum 714 after the image transfer. A transport belt 720 transports the paper sheet separated from the drum 714 to a fixing unit 722. The fixing unit 722 fixes the toner image on the paper sheet. A cleaning unit 723 removes the toner remaining on the drum 714 after the image transfer. A discharge lamp 724 dissipates the charge also remaining on the drum 714 after the image transfer. A temperature sensor and a humidity sensor, 725 collectively, is responsive to temperature and humidity and disposed in a pressure discharge duct included in the developing unit 716. A pretransfer lamp 726 effects illumination preliminarily to image transfer. A resistance sensor 727 is responsive to the electric resistance of the paper sheet. There are also shown in the figure a transfer charger 721*a*, and a timer 721*b* for adding up the durations of operation of the separation charger 721*b*.

In the embodiment, the drum 714 is implemented by a negatively chargeable organic semiconductor while the developer is implemented as a two-component developer containing a negatively chargeable toner. With such a drum and developer, the embodiment effects reversal development. Further, a counter 504, FIG. 14, adds up the turn-on times of the laser beam as image forming signals in order to determine an amount of toner to be supplied.

In operation, the light source 702 of the image reading section 700 scans a document laid on the glass platen 701. The resulting reflection or imagewise light from the document is incident to the CCD 707 via the mirrors 703, 704 and 705 and lens 706. The CCD 707 generates image data corresponding to the incident light. The image data are subjected to predetermined image processing and then emitted as a laser beam from a semiconductor laser, not shown. The laser beam is routed through the polygon mirror 711, f-theta lens 712 and mirror 713 to the surface of the drum 714 which has been uniformly charged. As a result, the laser beam electrostatically forms a latent image on the drum 714. Usually, the surface potential of the drum 714 is about −800 volts in the background (dark area potential; Vd), and about −100 volts in the image area (light area potential; VI). The latent image is developed by the developing unit 716 on the basis of the difference between such potentials and a bias potential Vb of about −600 volts. The resulting toner image is transferred by the transfer charger 721*a* to the paper sheet fed from the cassette 717 or 718 by the pick-up roller 717*a* or 717*b* via the register roller 719. The paper sheet carrying the toner image thereon is separated from the drum 714 by the separation charger 721*b*, transferred to the fixing unit 722 by the belt 720 to have the image fixed thereon, and then driven out of of the recorder body. After the image transfer, the cleaning unit 721 removes the toner remaining on the drum 714, and then the discharge lamp 724 dissipates the charge also remaining on the drum 714. The pretransfer charger 726 illuminates the drum 714 before the image transfer to be effected by the transfer charger 721*a*, thereby dissipating needless part of the charge deposited on the drum 714.

A reference pattern for image density control is formed on the drum 714 outside of an image forming area, once every ten copies. A reflection type photosensor or P sensor is located in close proximity to the drum 714 for outputting voltages Vsp and Vsg respectively representative of the reflectance of the reference image (developed reference pattern) and the reflectance of part of the drum 714 lying in the reference image. Whether the actual image density is high or low is determined by comparing the actual ratio Vsp/Vsg with Vsp/Vsg representative of a target image density.

Figure 14:
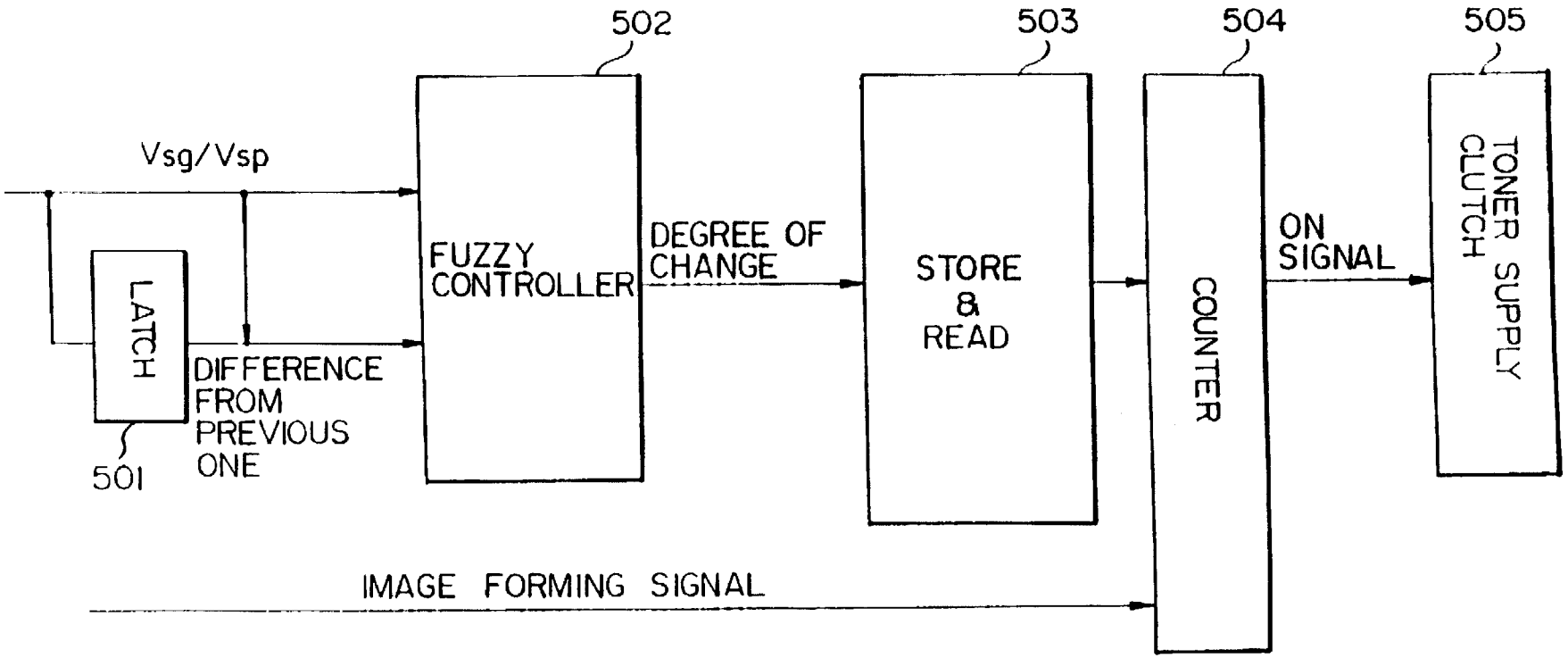
FIG. 14 is a block diagram of a control device for practicing the fourth embodiment.

FIG. 14 shows an image density control device for practicing the fourth embodiment. As shown, the control device has a fuzzy controller 502 which receives the current Vsp/Vsg and receives a difference between the current Vsp/Vsg and the previous Vsp/Vsg via a latch 501. In response, the controller 502 estimates a degree of change of the amount of toner supply per unit image forming signal, thereby determining an amount of toner supply (here, a degree of change) per unit amount of supply. A store and read section 503 stores the amount of toner supply per unit image forming signal matching the degree of change determined by the controller 502. Image forming signals (durations of laser turn-on) are applied to the counter 504. The time for turning on a toner supply clutch 505 and the time for turning it off are controlled on the basis of the amount of toner supply per unit amount of supply determined beforehand. As a result, the toner is supplied in an amount matching the image forming signals.

The estimation procedure of the fuzzy controller 502 is as follows. The controller 502 quantizes verbally represented control rules so as to replace them with actual numerical values. How to express the control rules is of primary importance since it has critical influence on the result of estimation and, therefore, the control ability; that is, parameters to use have to be adequately selected.

In the illustrative embodiment, Vsp/Vsg available with the photosensor is used as information representative of a target image density. Based on the history of Vsp/Vsg, it is possible to estimate the future image density. Hence, the embodiment changes the amount of toner supply per unit image forming signal so as to set up a desired density at all times. It is noteworthy that the simple amount of toner supply is replaced with the amount of toner supply per unit image forming signal. This is successful in preventing the control accuracy from changing with a change in the amount of image data to be formed between consecutive reference patterns (stated another way, the amount of toner consumption). The embodiment, therefore, remarkably enhances accurate control, compared to the case simply using the amount of toner supply.

Figure 16A:
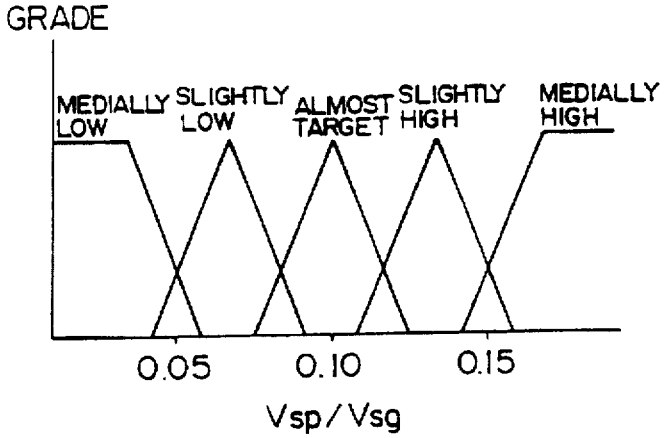
FIGS. 16A–16C show membership functions particular to the fourth embodiment.
Figure 16B:
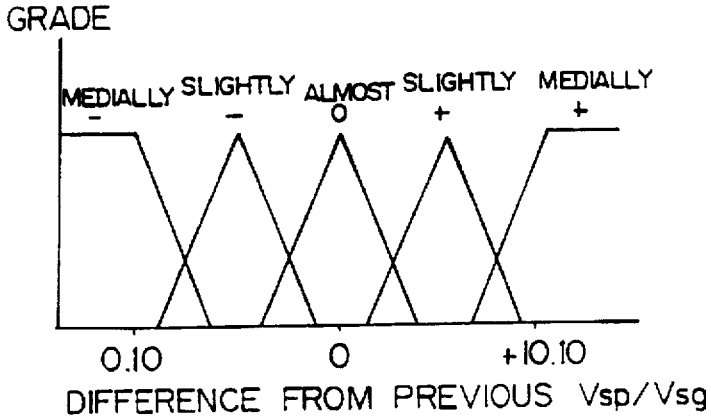
Figure 16C:
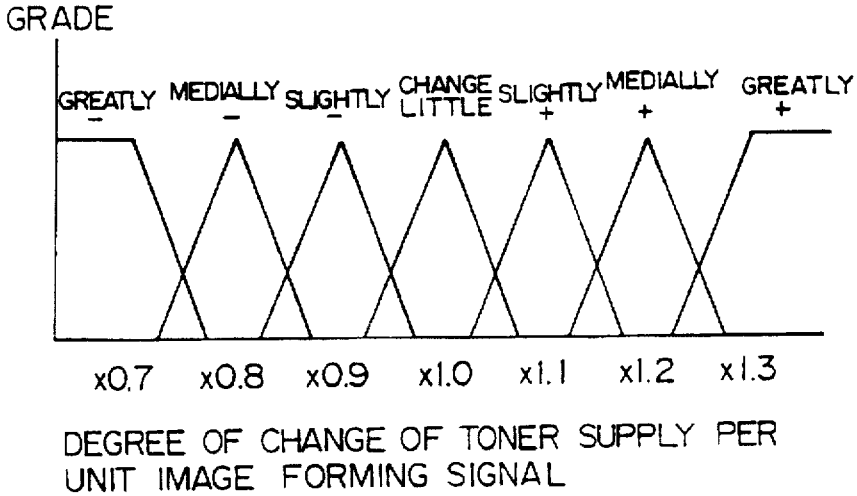

Further, using fussy estimation for total estimation, the embodiment replaces, e.g., the ambiguous concept that the image density is low with an expression that Vsp/Vsg of the P sensor is high. FIG. 15 shows verbally represented rules applicable to the embodiment. The rules each consists of an antecessor ("if . . . ") and a successor ("increase, not increase, etc."). Seven rules [I]–[VII] shown in FIG. 15 are represented by quantitative fuzzy variables on the basis of membership functions shown in FIGS. 16A–16C and can be computed. It is to be noted that rules [I]–[VII] are only illustrative and may be replaced with eight or more rules for more delicate control. As for the computation of the antecessor, MAX of the input value and the variable of the antecessor is produced to determine the degree of conformity of the antecessor to the input. Then, MIN of the variable of the successor and the degree of conformity of the antecessor is produced as a conclusion. Such a procedure is executed with all of the given rules. Finally, MAX of all of the conclusions is produced as the final result of estimation representative of a target amount of toner supply per unit image forming signal relative to set Q/M.

Figure 17:
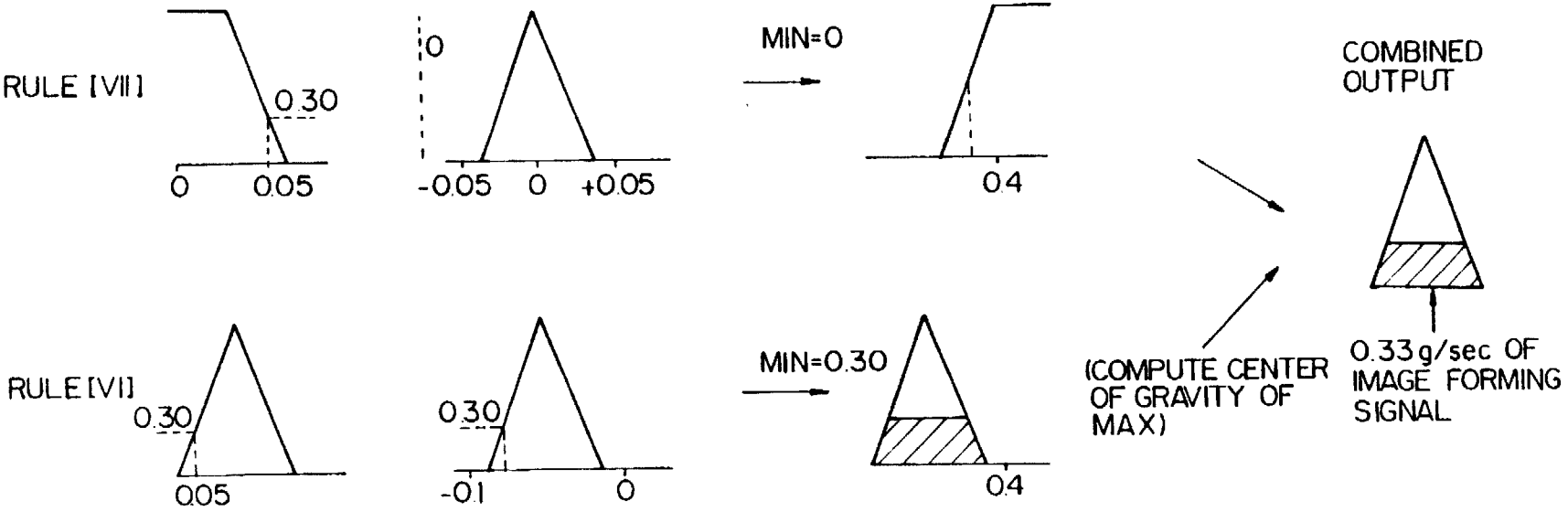
FIG. 17 demonstrates the operation of the fourth embodiment.

Specifically, assume that Vsp/Vsg is slightly low, and that the rate of change is slightly negative. Then, a target amount of toner supply is computed on the basis of such inputs and according to rules [I]–[VII]. As shown in FIG. 17, regarding, e.g., rule [VII], if Vsp/Vsg is 0.05 and the difference between it and the previous Vsp/Vsg is −0.075, Vsp/Vsg=0.05 is interpreted as "Vsp/Vsg is medium low" and "the grade (belonging degree) is 0.30". In this manner, the intersections with the membership functions belonging to the individual rules are computed. The minimum one (0, rule [VII]) of the intersections is produced as a conclusion. Subsequently, MAX of all of the conclusions is produced (indicated by hatching in the figure), and then the center of gravity thereof is determined. Consequently, a result of estimation is produced (here, a degree of change of the amount of toner supply per unit image forming signal, i.e., ×1.2). An amount of toner supply per unit image forming signal is stored in the store and read section 503 and is updated on the basis of the determined degree of change. For example, by a 0.275 gram per second of laser emission time×1.2, a laser emission time of 0.3 gram per second is determined. In the illustrative embodiment, the counter 504 is provided with an integration constant of 0.3 gram per second representative of a relation between the rotation time of a toner supply roller and the amount of toner supply. The times for turning the toner supply clutch 505 on and off are sequentially controlled on the basis of the amount of toner supply per unit image forming signal, i.e., 0.3 gram per second and the number of image forming signals counted. For example, if the cumulative turn-on time of the laser is 0.2 second, the clutch 505 will be coupled for 0.33 gram/1 second×0.2 second+0.3 gram/1 second=0.22 second to supply the required −0.66 gram of toner. While the cumulative turn-on time of the laser beam in which the toner should be supplied depends on the system, it is assumed to be 0.2 second in the embodiment.

By the above control, the embodiment supplies the toner in an amount matching the amount of consumption. Specifically, the embodiment finely corrects the amount of toner supply per unit image forming signal by fuzzy estimation. Therefore, the embodiment responds to the time-varying ambient conditions and the kind of a document more sharply than the conventional control relying on a photosensor or a toner concentration sensor, thereby setting up a desired image density at all times.

By changing the fuzzy rules (estimation rules), it is possible to apply the embodiment even to the process control of a different type of image recorder. In addition, the embodiment reduces the time and cost for development.

Fifth Embodiment

A fifth embodiment to be described is essentially similar to the fourth embodiment except that it has a toner concentration sensor disposed in the developing unit to sense the toner concentration when needed. With the toner concentration sensor, not shown, the embodiment determines average data every 0.5 second. The toner concentration sensor is of the type outputting a change in permeability ascribable to a change in toner concentration as a change in voltage. The embodiment determines whether the toner concentration is high or low by comparing the output voltage of the sensor with a voltage representative of a target toner concentration.

Figure 18:
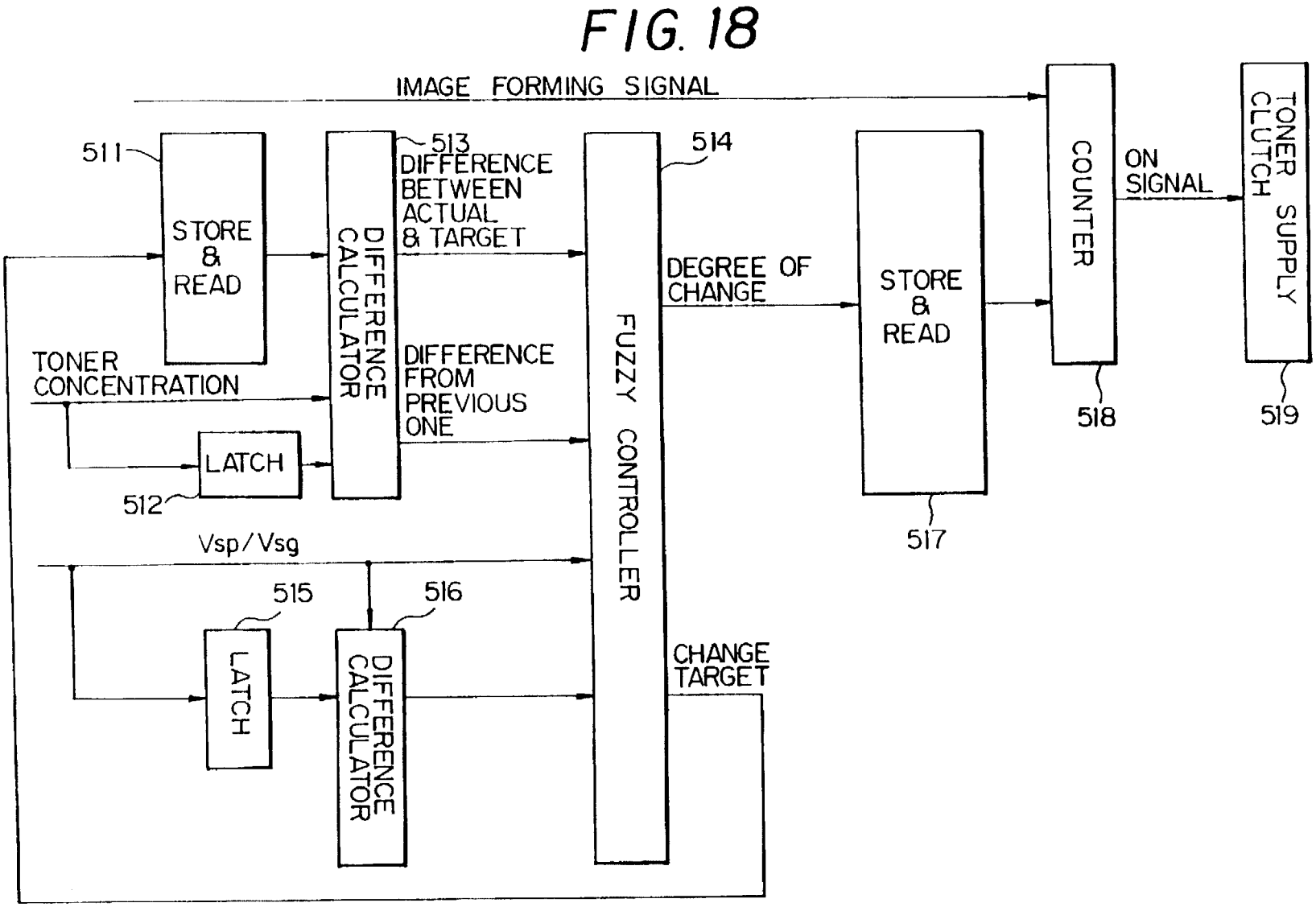
FIG. 18 is a block diagram of a control device for practicing a fifth embodiment of the present invention.

FIG. 18 shows an image density control device for practicing the fifth embodiment. As shown, the control device has a fuzzy controller 514, and a target concentration store and read section 511 storing a target toner concentration. A difference between the actual toner concentration and the target concentration is fed to the controller 514 via a latch 512 and a difference calculator 513. In response, the controller 514 estimates an amount of toner supply (here, a degree of change) to a unit image. Then, the controller 514 stores in a read and store section 517 an amount of toner supply per unit image forming signal matching the determined degree of change. The image forming signals (durations of laser turn-on) are applied to a counter 518 to be added up. The time for turning on a toner supply clutch 519 and the time for turning it off are controlled on the basis of the previously determined amount of toner supply per unit supply, whereby the toner is supplied in an amount matching the image forming signals. Further, on receiving a difference between the current Vsp/Vsg and the target Vsp/Vsg and a difference between the current Vsp/Vsg and the previous one via a latch 515 and a difference calculator 516, the fuzzy controller 514 updates the target toner concentration.

In this embodiment, by using Vsp/Vsg as a factor representative of a target image density and by receiving the history thereof, the fuzzy controller 514 determines whether or not to update the target toner concentration on the basis of whether or not the image is stable. Should the target toner concentration be changed despite that the image density is unstable, the image density to be finally reached would not converge, but it would diverge due to a delay of toner supply. Moreover, by using a difference between the actual and target concentrations and the history of concentration, the fuzzy controller 514 is capable of estimating the future concentration and, therefore, changing the amount of toner supply per unit image forming signal beforehand so as to maintain the target toner concentration at all times. Why the amount of toner supply per unit image forming signal is used in place of the simple amount of toner supply is the same as in the fourth embodiment.

Figure 20:
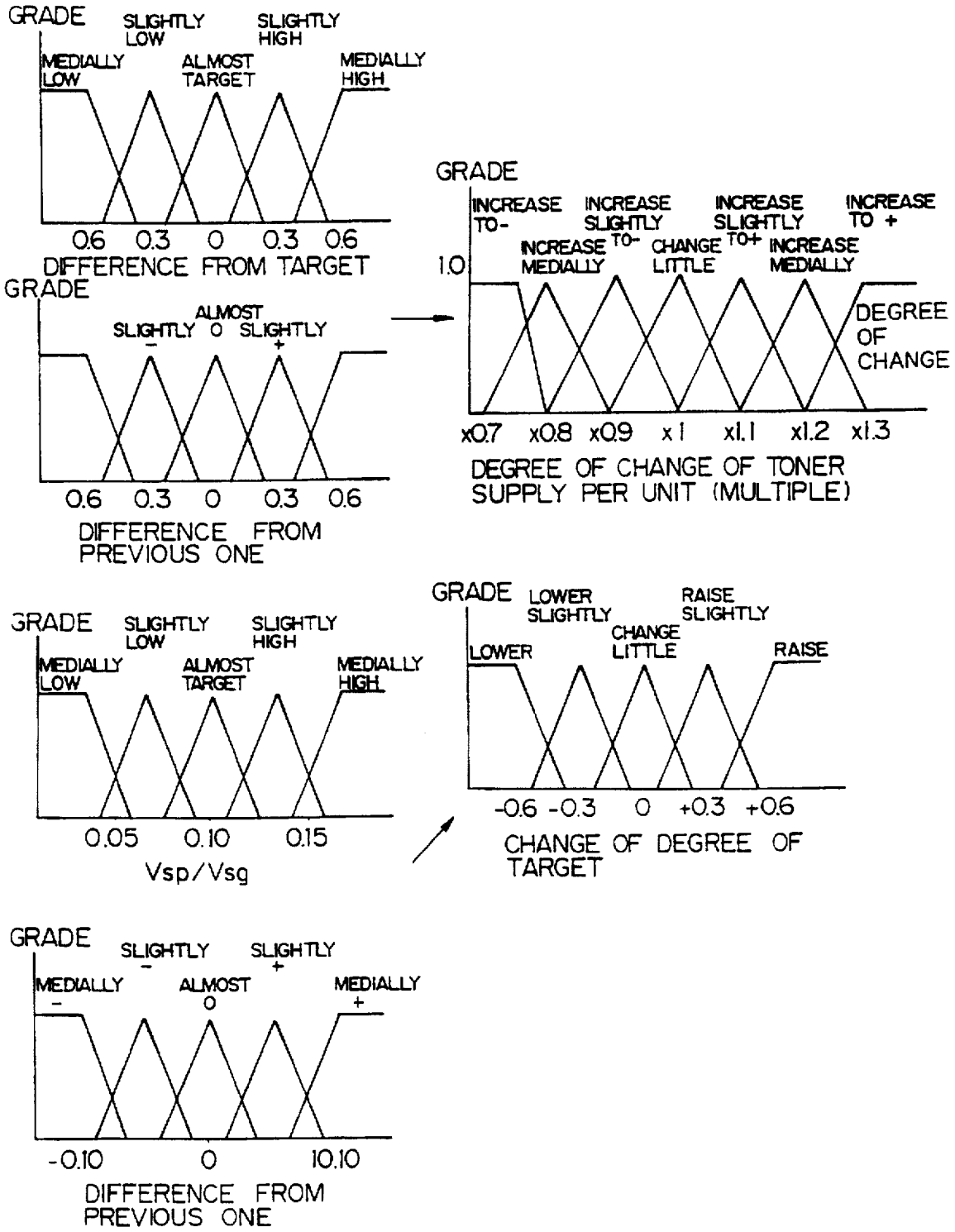
FIG. 20 shows membership functions particular to the fifth embodiment.

Using fuzzy estimation for total estimation, the embodiment also replaces, e.g., the ambiguous concept that the image density is low with an expression that Vsp/Vsg of the P sensor is high. FIG. 19 shows ten verbally expressed rules applicable to the embodiment. Again, the rules each consists of an antecessor ("if . . . ") and a successor ("increase, not increase, etc."). Rules [I]–[X] are represented by quantitative fuzzy functions based on membership functions shown in FIG. 20 and, therefore, can be computed. Assume that the actual toner concentration is 1.5 percent while the target concentration is 2 percent, and that the difference between the current concentration and the previous concentration is −0.5 percent. Then, the degree of change of the amount of toner supply per unit image forming signal is ×1.2. Regarding Vsp/Vsg, the target concentration can also be corrected by a similar calculation. The control over the rotation of the toner supply roller to follow is the same as in the fourth embodiment. With such a procedure, the embodiment additionally introduces a toner concentration and an image forming signal (constantly detectable parameters) into the relation between the image density (Vsp/Vsg) and the amount of toner supply per unit image forming signal described in relation to the fourth embodiment. Moreover, the embodiment finely corrects and controls such a relation by fuzzy estimation. This reduces the number of times that the reference pattern should be formed, while achieving the previous described advantages at the same time.

Figure 21:
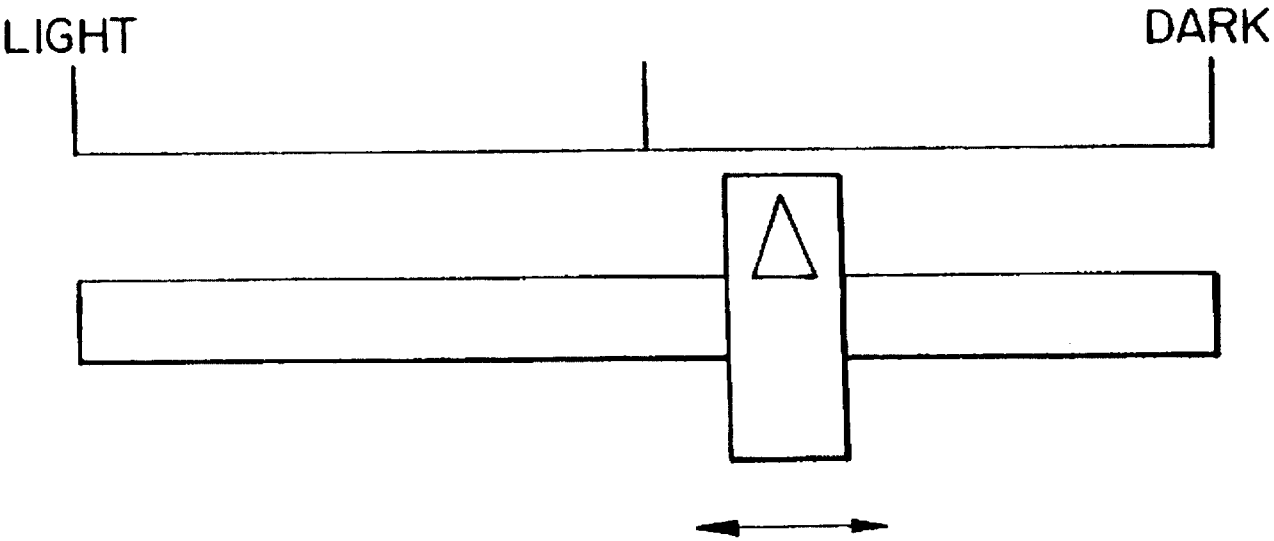
FIG. 21 shows a specific form of user-oriented inputting means.

FIG. 21 shows alternative inputting means which allows the operator to enter a desired ambiguous density in place of Vsp/Vsg. Then, rules [VIII]–[X] are used. In this case, the density will be entered copy by copy. The membership functions described in relation to Vsp/Vsg also hold. As stated above, by introducing ambiguous light/dark information in the membership functions, the embodiment is capable of converting the ambiguity to a particular numerical value to thereby effect accurate control.

Sixth Embodiment

This embodiment is practicable with an image recorder of the type having a temperature sensor and a humidity sensor (e.g. sensors 725. FIG. 13) and a drum operation time counter in place of the photosensor or P sensor of the fifth embodiment. This embodiment also uses fuzzy estimation for total estimation.

Figure 22:
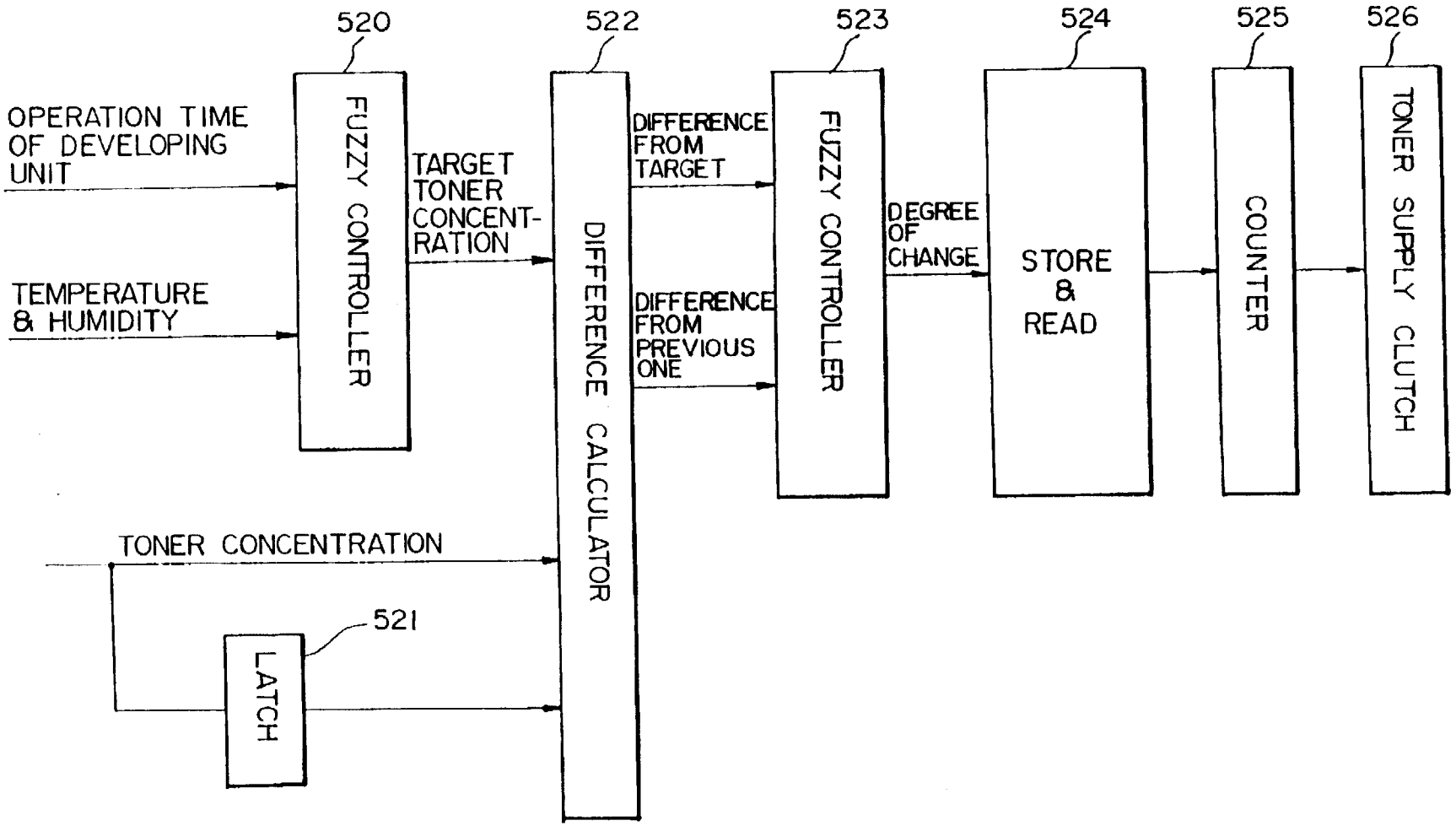
FIG. 22 is a block diagram of a control device with which a sixth embodiment of the present invention is practicable.

FIG. 22 shows an image density control device with which this embodiment is practicable. As shown, a fuzzy controller 520 receives a temperature and a humidity from the temperature and humidity sensors and the duration of drum operation from the drum operation time counter. Based on such inputs, the controller 520 performs fuzzy estimation to output a target toner concentration. A difference calculator 522 receives the target concentration from the controller 520, the current concentration, and the previous concentration from a latch 521, thereby producing a difference between the current and previous concentrations and a rate of change in the difference. By the estimation of the toner concentration, a controller 523 controls a toner supply clutch 526 via a store and read section 524 storing an amount of toner supply per unit time, and a counter 525, as in the fifth embodiment.

Generally, a two-component developer applicable to, e.g., an electrophotographic copier sequentially reduces the previously mentioned charging ability thereof due to deterioration ascribable to aging. In addition, in a low temperature and low humidity environment, the charge accumulation degree and, therefore, Q/M increases; in a high temperature and high humidity environment, the charge leak degree and, therefore, Q/M decreases. The embodiment sets up rules representative of such a relation so as to presume and control the developing ability of the developing unit without resorting to the photosensor or P sensor. Specifically, the embodiment estimates the deterioration of the developer due to aging in response to the output of the drum operation time counter, and estimates a change in Q/M in the environment surrounding the developer by the temperature and humidity sensors, thereby controlling the developing ability of the developing unit. This embodiment is similar to the fifth embodiment regarding how to deal with toner concentration.

Figure 24:
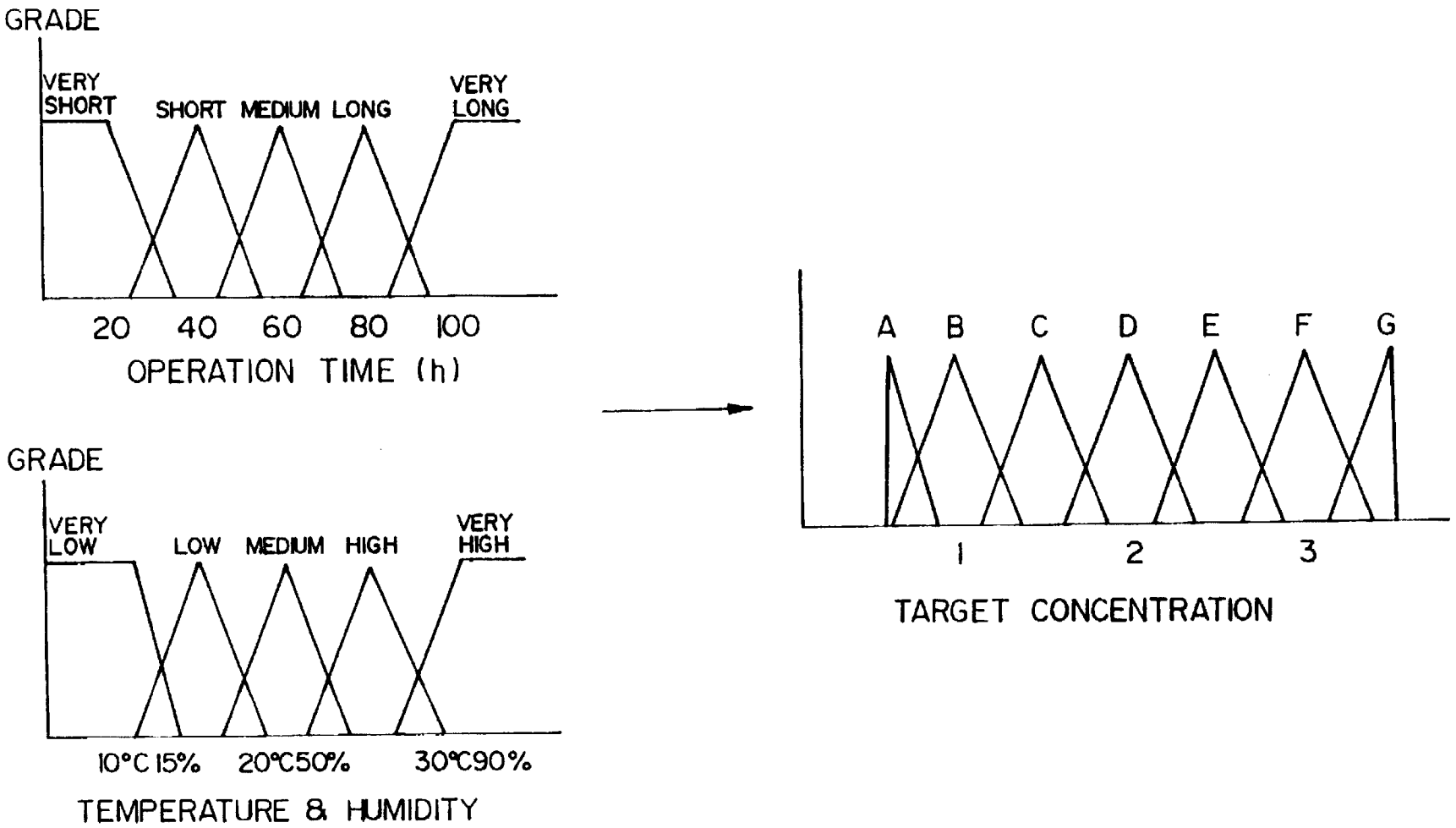
FIG. 24 shows membership functions particular to the sixth embodiment.

FIGS. 23A and 23B show sixteen estimation rules [I]–[XVI] particular to this embodiment. Rules [I]–[IX] are assigned to the fuzzy controller 520 while rules [X]–[XVI] are assigned to the fuzzy controller 523. Such sixteen rules are represented by quantitative fuzzy variables on the basis of membership functions shown in FIG. 24 and can be computed (rules [X]–[XVI] corresponding to FIG. 20). Assume that the cumulative duration of operation of the developing unit is 80 hours, and that the temperature and humidity are 20 degrees centigrade and 50 percent, respectively. Then, the toner concentration is 3 percent. Regarding the amount of toner supply per unit image forming signal, this embodiment is identical with the fifth embodiment. The control over the rotation of toner supply roller is effected in the same manner as in the fourth embodiment and will not be described specifically to avoid redundancy.

By the above control, the embodiment is practicable without resorting to the photosensor or P sensor of the fifth embodiment. This eliminates wasteful toner consumption, additional load on the cleaning unit, and decrease in copying speed which are ascribable to the P sensor. Of course, this embodiment, like the fifth embodiment, is practicable with the P sensor. Then, even when the surface potential of the drum changes with the varying number of paper sheets to be used, desired image density can be maintained even if the reference pattern is formed less frequently than conventional.

Seventh Embodiment

This embodiment is also practicable with the image recorder of FIG. 13 and capable of measuring the torque acting on an agitator disposed in the toner hopper of the developing unit, although not shown in the figure. The agitator torque changes with a change in the amount of toner existing in the hopper. Assume assume that the rotation speed of the toner supply roller can be freely changed on the main control board of the recorder body. It will be apparent from FIG. 13 that the rotation of the toner supply roller does not directly influence the agitator torque. Again, the total estimation is implemented by fuzzy estimation.

Figure 25:
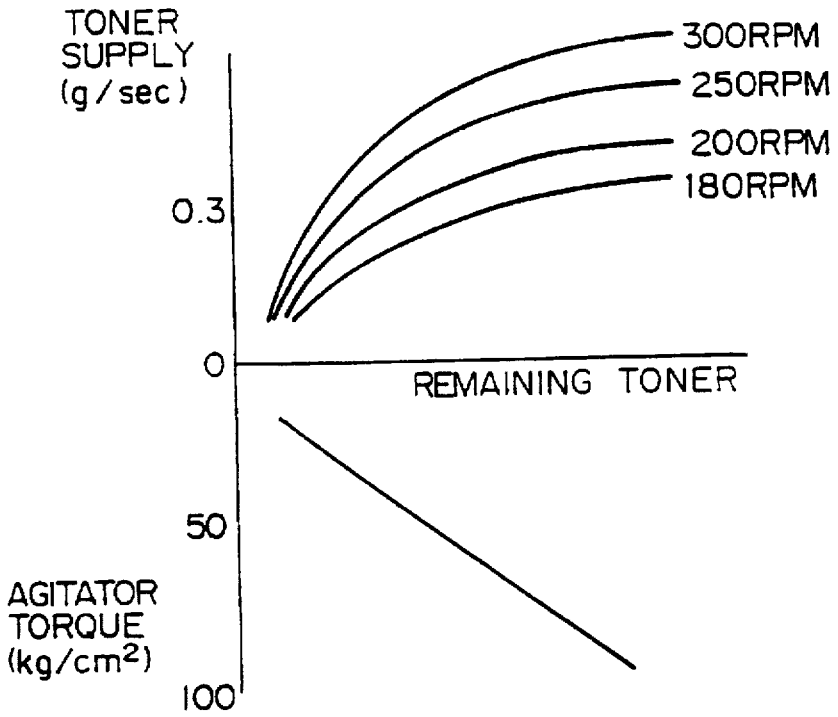
FIG. 25 is a graph indicative of a relation between the amount of toner supply, the remaining amount of toner, and the torque to act on an agitator.

As shown in FIG. 25, in an image recorder of the type supplying a toner by the rotation of a toner supply roller, the actual supply of toner depends on the amount of toner remaining in the hopper so long as the rotation speed is the same. In the light of this, the seventh embodiment controls the rotation speed of the toner supply roller on the basis of the agitator torque such that the duration of rotation of the roller and the amount of toner supply remain in a relation of 0.3 gram per second at all times.

Figure 26:
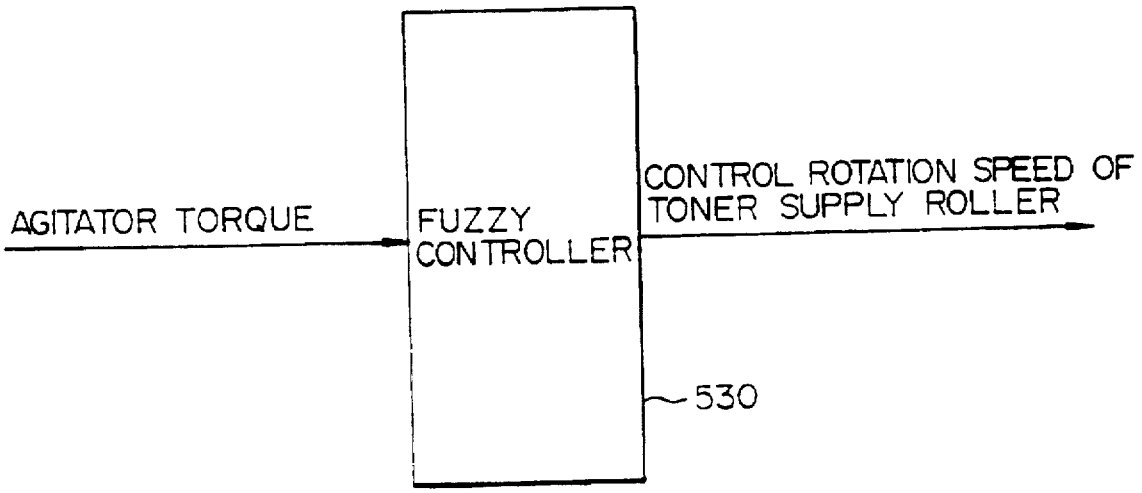
FIG. 26 is a block diagram of a control device for practicing a seventh embodiment of the present invention.
Figure 28:
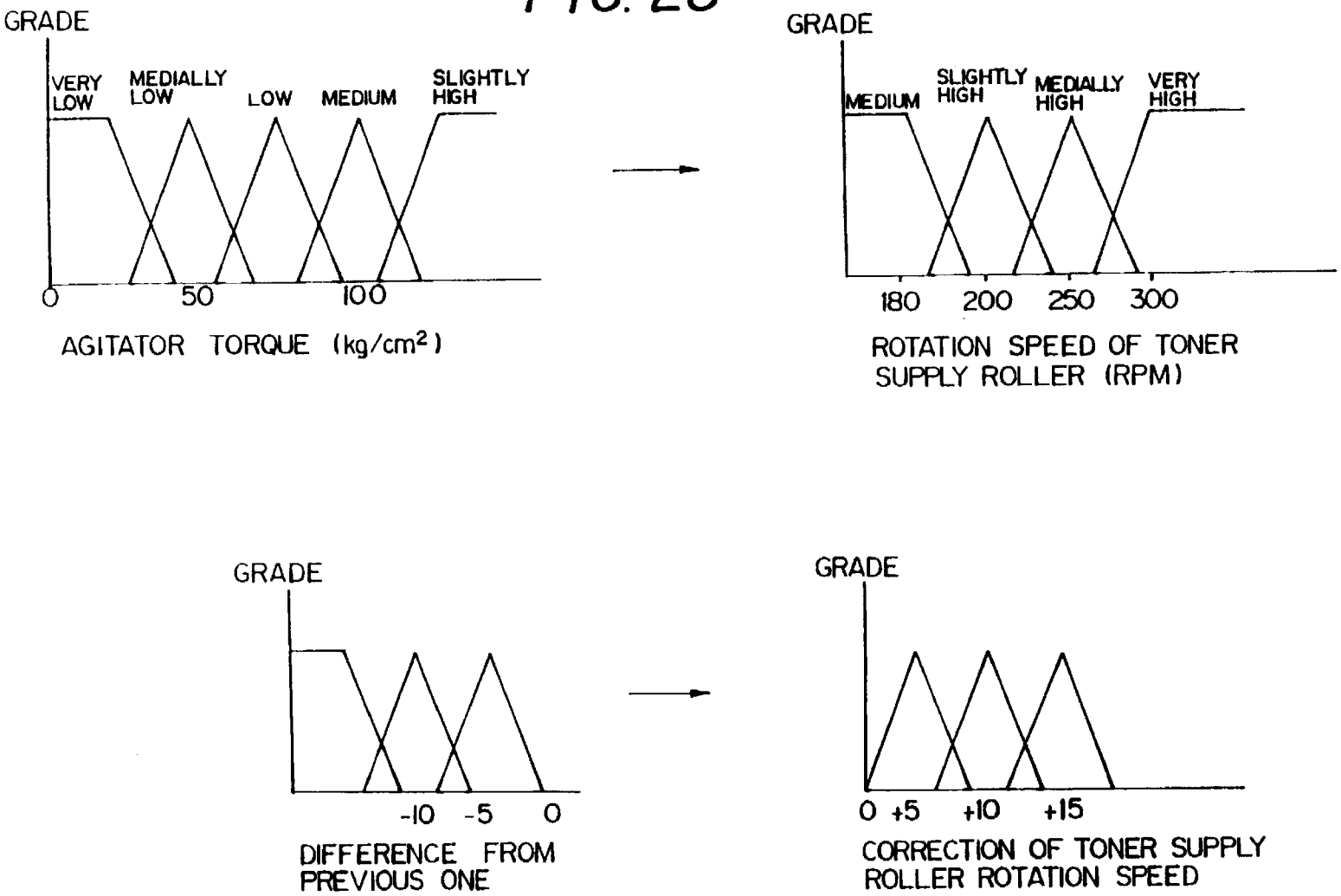
FIG. 28 shows membership functions particular to the seventh embodiment.

As shown in FIG. 26, in this embodiment, the agitator torque, i.e., the amount of toner remaining in the hopper is fed to a fuzzy controller 530 every five seconds, together with a difference between it and the previous one. In response, the controller 530 determines a control amount over the rotation of the toner supply roller by fuzzy estimation. The embodiment changes the rotation speed of the toner supply roller in order to maintain the amount of toner supply per unit image forming signal constant. Specifically, the embodiment measures the amount of remaining toner indirectly in terms of agitator torque and so controls the rotation speed of the roller as to maintain the actual amount of toner supply constant. FIG. 27 shows five control rules [I]–[V] particular to this embodiment. For each of the rules [I]–[V], membership functions shown in FIG. 28 are prepared to determine a correction amount. For example, assume that the agitator torque is 50 kilograms per square centimeter, and that the difference between the current and previous agitator torques is −5 kilograms per square centimeter. Then, the rotation speed of the toner supply roller is estimated to be 205 revolutions per minute.

With such a procedure, this embodiment is capable of maintaining a desired amount of toner supply even when the amount of toner remaining in the hopper is small. Of course, the embodiment may increase the duration of toner supply instead of changing the rotation speed of the toner supply roller.

Eighth Embodiment

This embodiment is also practicable with the image recorder of FIG. 13 and capable of changing the image forming condition and the bias condition for development by a conventional method. With this embodiment, it is possible to change the actual amount of development by changing the potential for development (Vl–Vb) independently of the developing unit. Even when the developing ability of the developing unit is lowered relative to the target potential, the embodiment compensates for it by changing the potential (Vl–Vb), thereby maintaining the target amount of development (image density).

Regarding the image recorder of the type supplying a toner in response to image forming signals, as in the fourth to sixth embodiments, when a target toner concentration is not reached, the difference between the actual and target concentrations can be presumed in terms of the remainder of toner supply signals having not caused the toner to be supplied. This embodiment stems from this and also uses fuzzy estimation for total estimation.

Figure 29:
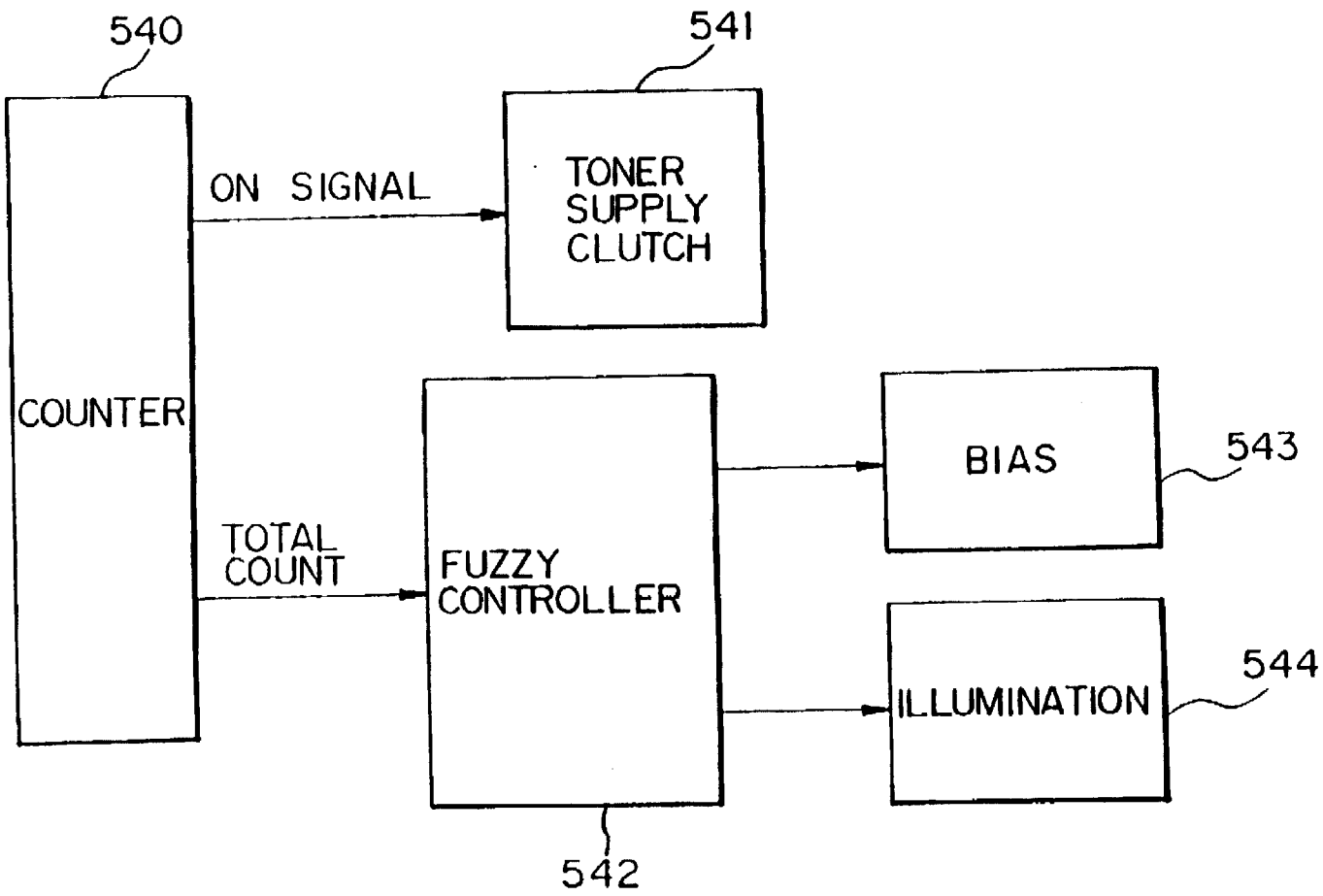
FIG. 29 is a block diagram of a control device for practicing an eighth embodiment of the present invention.
Figure 31:
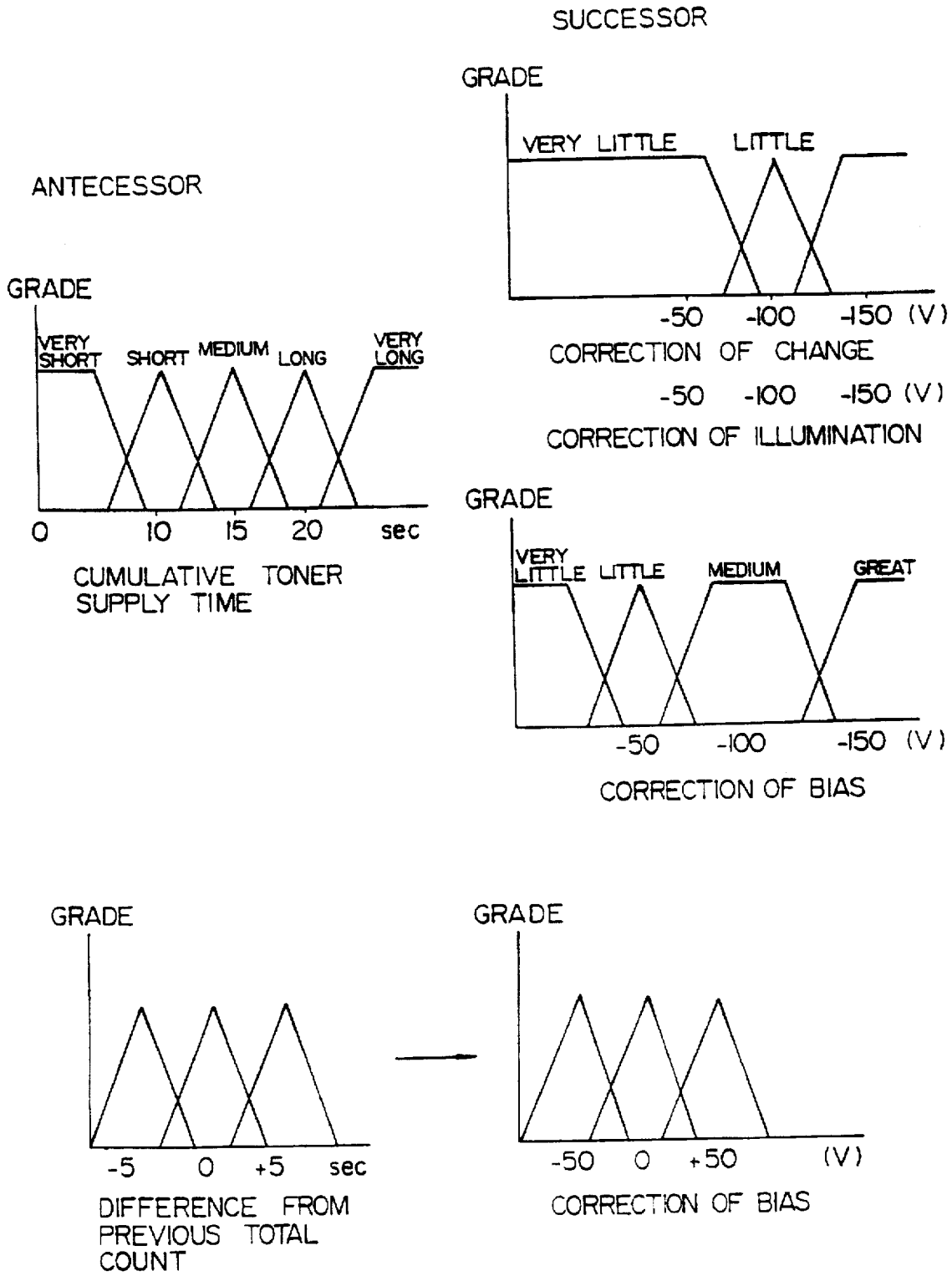
FIG. 31 shows membership functions particular to the eighth embodiment.

Specifically, as shown in FIG. 29, a toner supply signal counter 540 delivers the remainder of toner supply signals (total count) to a fuzzy controller 542. In response, the controller 542 performs fuzzy estimation to determine an object of control and an amount of control. In the illustrative embodiment, the controller 542 controls either of two (or more) objects, i.e., a bias for development 543 and illumination for charging 544. This is because although changing the bias 543 is basically desirable in respect of response, the variable range thereof is limited. The toner supply signals are added up. A toner supply clutch 541 is turned on and turned off by an adequate toner supply signal. Further, the embodiment executes fuzzy estimation on the basis of the count and a supply time signal so as to select an object of control.

Figure 32A:
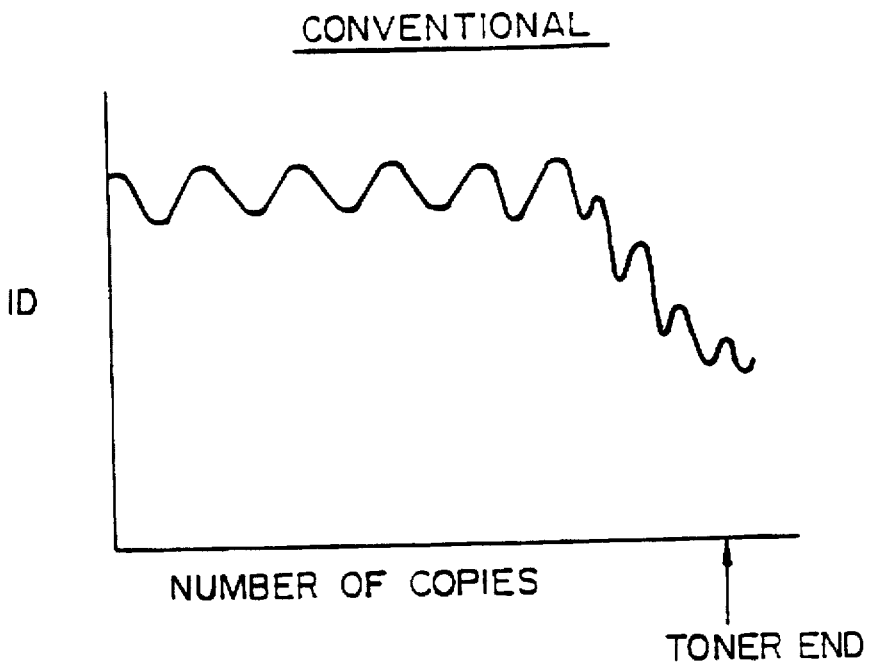
FIG. 32 shows graphs useful for understanding the advantage of the combination of the fifth to eighth embodiments over the conventional control using a photosensor or P sensor.
Figure 32B:
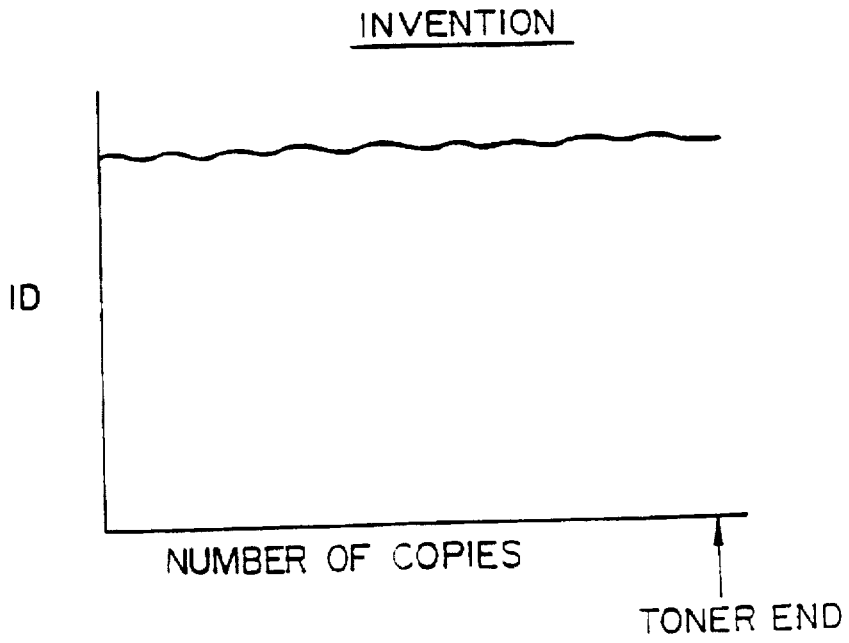

In detail, after one frame of image signal has been output (i.e. after exposure), the object of control is estimated on the basis of a difference between the remainder of the total counter and the previous value and according to rules [I]–[IV] shown in FIG. 30. As a result, a bias for development, grid voltage, and exposure condition are selected, and then the object is controlled. It is to be noted that such correction is reset to the initial state (Vb=–800 volts, Vl=–50 volts, and Vl=–600 volts) every time, and then control is repeated on the basis of the result of estimation. Membership functions shown in FIG. 32 are prepared for all of the rules [I]–[VI], and then estimation is performed to determine an object of control and an amount of control. For example, assume that the cumulative total count (i.e. a period of time for supplying the toner having not supplied) is 20 seconds, and that the difference between the current and previous periods of time is –1 second. Then, the bias for development is increased from the set value by –100 volts plus –50 volts, i.e., –150 volts in total so as to increase the amount of exposure by +100 volts. This prevents the image density from falling in an amount corresponding to the amount of toner short of the target toner concentration. Of course, a potential difference greater than predetermined one is maintained between the charge potential and the bias for development in order to prevent the carrier from depositing on the image. With this embodiment, even when the amount of toner supply is too short to prevent the image density from falling, e.g., when an image having a substantial area is reproduced or when a toner near end condition is reached, it is possible to temporarily maintain the actual image density at desired one. It should be noted that the fourth to eighth embodiments shown and described are practicable either independently or in combination, as desired. FIG. 32 shows graphs representative of the advantage of the combination of such embodiments over the conventional control using the photosensor or P sensor only.

In summary, it will be seen that the present invention provides an image density control method which insures stable toner concentration by eliminating sharp changes in toner concentration, enhances accurate control by reducing the range of scattering in toner concentration by taking account of the interval between the supply of toner and the resulting increase in toner concentration, reduces the amount of toner to be consumed by image density control, and performs toner concentration control stable at all times with no regard to the toner consumption association with documents.

The method of the present invention makes total decision on pluralistic information and, therefore, copes with all the possible changes in environment as would usually arise. Further, the accuracy regarding a target image density is enhanced to noticeably reduce the number of times that a reference pattern should be formed. This minimizes wasteful toner consumption and additional load to act on a cleaning unit while insuring a high copying speed. The method of the invention responds to time-varying ambient conditions and the kind of a document more sharply than the conventional method using a photosensor or P sensor or a toner concentration sensor, insuring stable image density. Even the ambiguous light/dark information entered by the operator is adequately processed to set up desired image density. The amount of toner supply is maintained constant despited that the amount of toner remaining in a toner hopper changes. A target image density is maintained even when a great amount of toner is continuously consumed and a great amount of toner supply is needed, e.g., when a black solid image is continuously formed. Optimal image density control is executed by determining the cause of deterioration of the developer. In addition, by executing toner supply control each time of estimation and executing the other control only once when a scanner senses the leading edge of a document for a single copy, it is possible to prevent the image density from sharply changing during the course of operation. The influence of a change in the potential of a photoconductive element is absorbed to promote stable image density control. A temperature sensor and a humidity sensor are disposed in a pressure discharge duct included in a developing unit, and therefore they are free from contamination. Furthermore, since the control condition and, therefore, image density is controlled during the course of image formation, delicate control is achievable.

Various modifications will become possible for those skilled in the art after receiving the teachings of the present disclosure without departing from the scope thereof.

What is claimed is:

1. An image forming method comprising the steps of:

estimating a control value of a toner supply member on the basis of an amount of toner remaining in a toner hopper and history data thereof; and controlling said toner supply member such that an amount of toner actually supplied remains constant relative to an amount of toner to be replenished.

2. A method according to claim 1, wherein the control value of said toner supply member represents a rotation speed thereof.

3. A method according to claim 1, wherein the control value of the toner supply member represents a duration of rotation thereof.

4. A method according to claim 1, wherein the amount of toner to be replenished is determined on the basis of an image forming signal.

5. A method according to claim 4, wherein the control value of said toner supply member represents a rotation speed thereof.

6. A method according to claim 4, wherein the control value of the toner supply member represents a duration of rotation thereof.

7. A method according to claim 1, wherein the amount of toner remaining in the toner hopper and the history data thereof are determined in terms of a load acting on the rotation of an agitator.

8. An image forming apparatus comprising:

a toner hopper which contains toner;

a toner supply member which supplies toner in accordance with a control value thereof; and means for estimating said control value of said toner supply member on the basis of an amount of toner remaining in said toner hopper and history data thereof, such that an amount of toner actually supplied by said toner supply member remains constant relative to an amount of toner to be replenished.

9. An apparatus according to claim 8, wherein the control value of said toner supply member represents a rotation speed thereof.

10. An apparatus according to claim 8, wherein the control value of said toner supply member represents a duration of rotation thereof.

11. An apparatus according to claim 8, wherein the amount of toner to be replenished is determined on the basis of an image forming signal.

12. A method according to claim 11, wherein the control value of said toner supply member represents a rotation speed thereof.

13. A method according to claim 11, wherein the control value of said toner supply member represents a duration of rotation thereof.

14. An apparatus according to claim 8, wherein the amount of toner remaining in said toner hopper and the history data thereof are determined in terms of a load acting on the rotation of an agitator.

15. An image forming apparatus comprising:

computing means for computing an amount of toner to be replenished;

sensing means for sensing an amount of toner remaining in a toner hopper;

storing means for storing a history of the amount of toner sensed by said sensing means;

replenishing means for replenishing toner into a developing device from toner stored in said toner hopper;

control means for controlling said replenishing means by a variable amount on the basis of an output of said sensing means and an output of said storing means for a same amount of toner computed by said computing means.

16. An image forming apparatus comprising:

a toner hopper storing toner and including a toner replenishing member; and a control device for controlling said toner replenishing device such that even when an amount of the toner remaining in said toner hopper varies, the toner is replenished in a constant amount.

* * * * *